US011310598B2

(12) United States Patent
Enamito

(10) Patent No.: US 11,310,598 B2
(45) Date of Patent: Apr. 19, 2022

(54) ACOUSTIC CONTROL APPARATUS, METHOD, PROGRAM, AND DEVICE INCLUDING THE APPARATUS

(71) Applicant: KABUSHIKI KAISHA TOSHIBA, Minato-ku (JP)

(72) Inventor: Akihiko Enamito, Kawasaki (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 205 days.

(21) Appl. No.: 16/804,249

(22) Filed: Feb. 28, 2020

(65) Prior Publication Data

US 2021/0084411 A1 Mar. 18, 2021

(30) Foreign Application Priority Data

Sep. 18, 2019 (JP) ..... JP2019-169116

(51) Int. Cl.
*H04R 3/04* (2006.01)
*G10L 25/51* (2013.01)

(52) U.S. Cl.
CPC ..... *H04R 3/04* (2013.01); *G10L 25/51* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,506,380 | A | 3/1985 | Matsui | |
| 2012/0183150 | A1* | 7/2012 | Christoph | H03G 3/32 381/57 |
| 2012/0328108 | A1* | 12/2012 | Enamito | H04S 7/302 381/17 |
| 2013/0336490 | A1 | 12/2013 | Someda | |
| 2014/0169595 | A1 | 6/2014 | Enamito et al. | |
| 2015/0092944 | A1* | 4/2015 | Someda | H04S 7/302 381/1 |
| 2015/0248897 | A1 | 9/2015 | Nakayama | |
| 2015/0350788 | A1 | 12/2015 | Someda et al. | |

FOREIGN PATENT DOCUMENTS

| | | | |
|---|---|---|---|
| JP | 59-9699 | A | 1/1984 |
| JP | 5-153685 | A | 6/1993 |
| JP | 5-161192 | A | 6/1993 |
| JP | 3083296 | B2 | 9/2000 |
| JP | 2007-19980 | A | 1/2007 |

(Continued)

*Primary Examiner* — Duc Nguyen
*Assistant Examiner* — Assad Mohammed
(74) *Attorney, Agent, or Firm* — Oblon, McClelland, Maier & Neustadt, L.L.P.

(57) ABSTRACT

According to one embodiment, an acoustic control apparatus includes a first calculator, a second calculator, and a first setting unit. The first calculator calculates a first relationship established between acoustic filter coefficients, based on sounds emitted from sound sources. The second calculator calculates a second relationship established between the acoustic filter coefficients by matching a first sound pressure ratio with a second sound pressure ratio, in a complex sound pressure ratio between ears of a user who desires the sound information. The first setting unit sets an acoustic filter coefficient corresponding to each of the sound sources, based on the first relationship and the second relationship.

12 Claims, 14 Drawing Sheets

(56) References Cited

FOREIGN PATENT DOCUMENTS

| | | | |
|---|---|---|---|
| JP | 4282139 | B2 | 6/2009 |
| JP | 4715052 | B2 | 7/2011 |
| JP | 4817804 | B2 | 11/2011 |
| JP | 2014-17813 | A | 1/2014 |
| JP | 2014-68266 | A | 4/2014 |
| JP | 2015-76797 | A | 4/2015 |
| JP | 2015-228571 | A | 12/2015 |
| JP | 5966897 | B2 | 8/2016 |
| JP | 6452377 | B2 | 1/2019 |

* cited by examiner

| | | | |
|---|---|---|---|
| d=0.3m | : 0 | 283Hz | 566Hz |
| f=100Hz | : 0 | 0.85m | 1.7m |

Acoustic power reducing limitation index

| Position of sound source | Fixed | Shift | |
|---|---|---|---|
| | | Each sound source interval is also shifted | Each sound source interval is fixed |
| Minimization of acoustic power | O | × | Arrangement of present embodiment O |
| Reproduction of virtual acoustic image | O | × | Arrangement of present embodiment O |

ACOUSTIC CONTROL APPARATUS, METHOD, PROGRAM, AND DEVICE INCLUDING THE APPARATUS

CROSS-REFERENCE TO RELATED APPLICATIONS

This application is based upon and claims the benefit of priority from Japanese Patent Application No. 2019-169116, filed Sep. 18, 2019, the entire contents of all of which are incorporated herein by reference.

FIELD

Embodiments described herein relate generally to an acoustic control apparatus, a method, a program, and a device including the acoustic control apparatus.

BACKGROUND

Recently, various technologies for supporting drivers have been developed. Referring to automobiles as an example of the technologies, there exist car navigation systems for supporting drivers, advanced driver-assistance systems (referred to as "ADAS"), or automated driving systems, etc. In these technologies, speech guidance for supporting drivers and warning sounds for warning drivers are often used. Therefore, within an indoor room of a space including a driver seat or an audio seat of a device (e.g., an automobile or audio system) adopting these technologies, opportunities for persons other than the driver or audience to have contact with unnecessary sounds are increased. In an automobile, in most cases, persons who are not engaged in the driving take rear seats. Therefore, it is desired to suppress unnecessary sounds. Particularly, in a high-priced luxury automobile, a very important person (abbreviated as "VIP") often takes the rear seat, and in most cases, VIPs desire to be in an environment for himself or herself. Therefore, it is desired to suppress these unnecessary sounds as much as possible.

DETAILED DESCRIPTION

Hereinafter, embodiments (hereinafter, also referred to as "present embodiments") according to one aspect of the present invention will be described based on the drawings. It should be noted that in the following embodiments, repeated descriptions on portions provided with the same numbers will be omitted basically, assuming that those portions perform the same operation.

An object of the embodiments is to provide an acoustic control apparatus, method, program, and a device including the acoustic control apparatus that are capable of making it difficult to here sounds in regions other than a particular region.

According to one embodiment, an acoustic control apparatus includes an acquisition unit, a first calculator, a second calculator, and a first setting unit. The acquisition unit obtains a sound signal including sound information. The sound signal is based on sounds emitted from sound sources. The first calculator calculates a first relationship established between acoustic filter coefficients, based on the sounds which are driven by a drive signal obtained by applying the sound signal to the acoustic filter coefficients set for each sound source. The second calculator calculates a second relationship established between the acoustic filter coefficients by matching a first sound pressure ratio with a second sound pressure ratio, in a complex sound pressure ratio between ears of a user who desires the sound information. The first sound pressure is based on a synthetic sound of the sounds emitted from the sound sources, and the second sound pressure is based on a virtual sound source, assuming that the virtual sound source of a virtual acoustic image is present in an incoming direction of the synthetic sound. The first setting unit sets an acoustic filter coefficient corresponding to each of the sound sources, based on the first relationship and the second relationship.

First Embodiment

The outline of the acoustic control apparatus of the present embodiment will be described using FIG. 1. It should be noted that other embodiments of the acoustic control apparatus also have the same configuration as that shown in FIG. 1.

Figure 1:
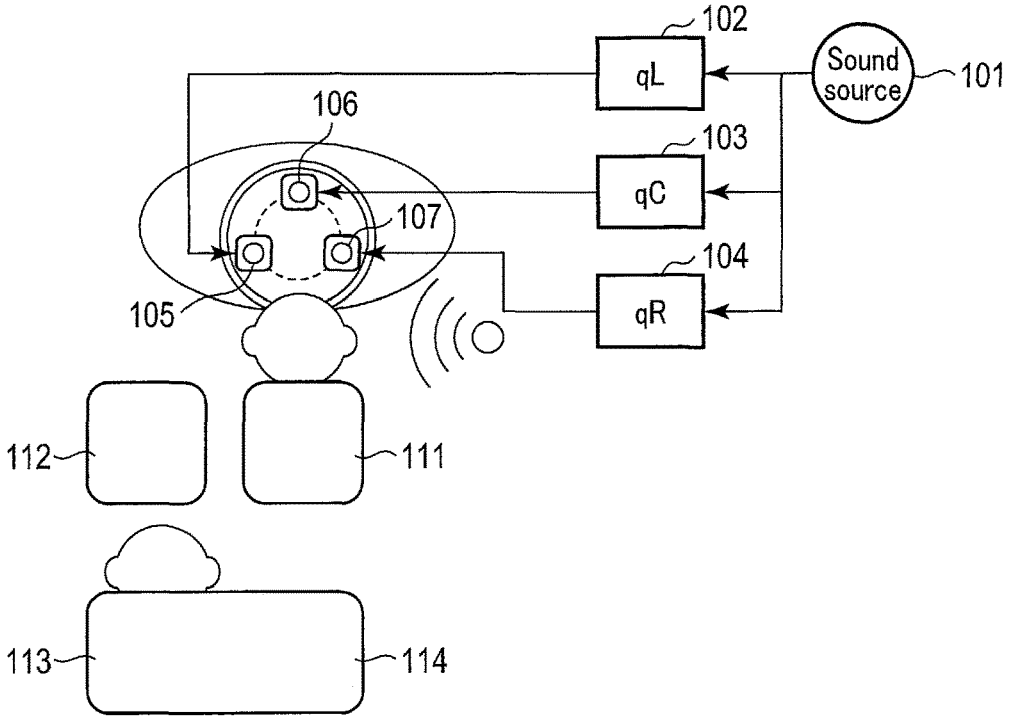
FIG. 1 is a view showing an example of the outline of an acoustic control apparatus according to first, second, and third embodiments.

FIG. 1 schematically and exemplarily illustrates a sound source 101; acoustic filters 102, 103, and 104; loudspeakers 105, 106, and 107, a driver seat region 111, a passenger seat region 112, a VIP seat region 113, and a rear seat region 114, according to an example of the outline of the present embodiment. In FIG. 1, as a space to which the acoustic control of the present embodiment is applied, the inside of an automobile is assumed.

The acoustic control apparatus according to the present embodiment calculates respective filter coefficients of the acoustic filters 102, 103, and 104. The acoustic control apparatus filters a voice signal whose sound has been converted from the sound source 101 through the acoustic filters 102, 103, and 104 to which these calculated filter coefficients have been applied and emits controlled sounds from the respective loudspeakers 105, 106, and 107. All of sounds emitted from the loudspeakers 105, 106, and 107 have the same phase and the same amplitude. However, if phase differences and the amplitude differences are known in advance, even if the phase differences and/or amplitude differences are present in a plurality of sound sources, the filter coefficients may be calculated taking these phase differences and/or amplitude differences into account. It should be noted that the voice signal is a signal including sounds and/or voices, and generally, an analogue signal. However, the voice signal may be a digital signal. In this case, it suffices that the acoustic filters 102, 103, and 104, and loudspeakers 105, 106, and 107 can process the digital signal. In addition, the frequency of a sound from the sound source 101 may be changed using an apparatus capable of operating the frequency of the sound source 101.

The acoustic control apparatus shown in FIG. 1 is characterized in that how the acoustic filters 102, 103, and 104 are controlled, and how the loudspeakers 105, 106, and 107 as sound sources are arranged.

Although FIG. 1 shows only three loudspeakers 105, 106, and 107, if a plurality of sound sources (e.g., loudspeakers) are arranged, the acoustic control apparatus of the present embodiment exhibits a particular effect as understood from the following description.

Figure 2:
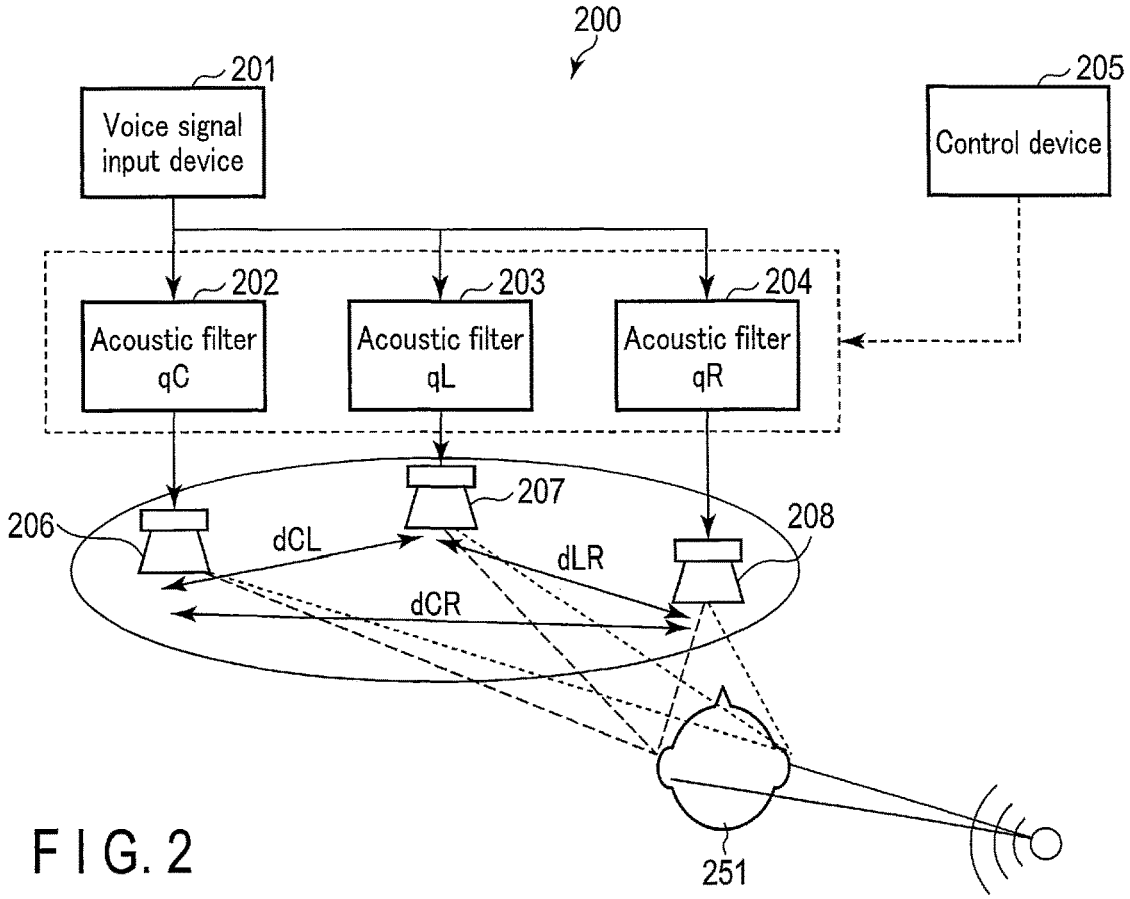
FIG. 2 is a schematic block view showing an example of the acoustic control apparatus according to the first embodiment.

Next, the acoustic control apparatus according to the first embodiment will be described with reference to FIG. 2. FIG. 2 is a schematic block view showing an example of the acoustic control apparatus according to the present embodiment.

The acoustic control apparatus according to the present embodiment includes a voice signal input device 201, acoustic filters 202, 203, and 204, a control device 205, and loudspeakers 206, 207, and 208. In addition, as a user 251 who desires to catch sounds emitted from the respective loudspeakers 206, 207, and 208, a driver who drives an automobile, etc. is assumed in this example. In this embodiment, it is assumed that the driver obtains, for example, information generated by a car navigation system installed in the automobile steered by the driver by hearing the sounds emitted from the system. Also, the acoustic control apparatus of the present embodiment may be used when the loudspeakers 206, 207, and 208 emit sounds, such as music, etc., and the user 251 is listening to the music, etc. The acoustic control apparatus of the present embodiment is not limited to these use examples and may be applied to discretional use examples if the use examples are examples of controlling an audio so as to enable the user to hear sounds in regions other than the region where the user 251 resides, and enables only the user 251 to hear desired sounds.

The voice signal input device 201 generates or obtains a voice signal including information to be conveyed to the user 251.

The acoustic filters 202, 203, and 204 acquire and filter voice signals, and output the filtered signals (also referred to as "drive signals") to corresponding loudspeakers 206, 207, 208. These acoustic filters allow only sounds of a specific frequency domain of the voice signals to pass through.

The control device 205 is a device for determining acoustic filter coefficients of the acoustic filters 202, 203, and 204, based on information related to sounds emitted from the sound sources and a complex sound pressure ratio between the ears of the user 251.

The loudspeakers 206, 207, and 208 input a voice signal which is an output signal of a corresponding acoustic filter and emit sounds corresponding to the voice signal.

<Control Device 205 of Acoustic Control Apparatus>

Figure 3:
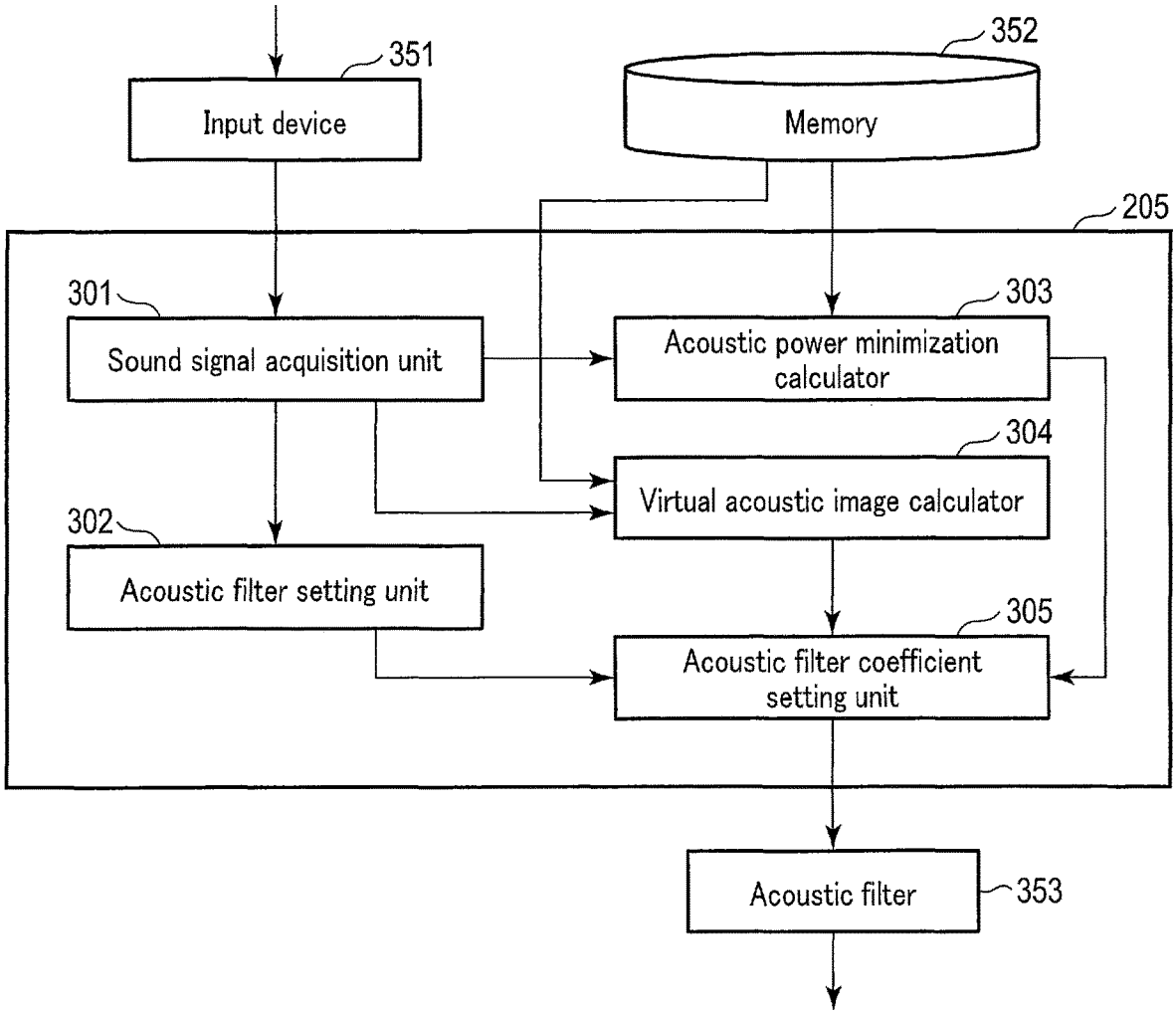
FIG. 3 is a view mainly showing an example of a control device included in the acoustic control apparatus shown in FIG. 2.

Next, the control device 205 included in the acoustic control apparatus shown in FIG. 2 will be described with reference to FIG. 3. FIG. 3 is a functional block view showing elements included in the control device of the acoustic control apparatus.

The control device 205 of the acoustic control apparatus includes a sound signal acquisition unit 301, an acoustic filter setting unit 302, an acoustic power minimization calculator 303, a virtual acoustic image calculator 304, and an acoustic filter coefficient setting unit 305.

The sound signal acquisition unit 301 obtains a sound signal including information related to sounds from an input device 351. The sound information includes at least frequency information, amplitude information, and phase information. Here, it is described as "frequency information"; however, it is defined that the frequency information includes the same information as wavenumber information including wavenumbers included in the sound information, assuming that the sound speed has been already known from other data. The sound signal acquisition unit 301 outputs the sound signal to the acoustic power minimization calculator 303 and the virtual acoustic image calculator 304.

The acoustic filter setting unit 302 sets an acoustic filter coefficient of at least one acoustic filter out of the respective acoustic filters 202, 203, and 204. The number of the acoustic filters to be set depends on the number of loudspeakers. For example, when the number of loudspeakers is three, it suffices that the acoustic filter setting unit 302 sets an acoustic filter coefficient of a single acoustic filter. In the case of the acoustic control apparatus of the present application, when the number of loudspeakers is N, usually, it suffices that the acoustic filter setting unit 302 sets N−2 acoustic filters, unless there is a particular matter (such a case where other conditional equation for determining an acoustic coefficients arises depending on the environment or circumstances, etc.).

The acoustic power minimization calculator 303 receives the sound signal from the sound signal acquisition unit 301 and obtains wavenumber information of the sound. Also, the acoustic power minimization calculator 303 obtains data of arrangement intervals of these loudspeakers 206, 207, and 208 from a memory in which the arrangement intervals of these loudspeakers are stored. The acoustic power minimization calculator 303 then performs a calculation for minimizing the acoustic power, using the wavenumber information and the data of arrangement intervals between the loudspeakers, and calculates a first relational expression established between the respective acoustic filter coefficients of the acoustic filters 202, The virtual acoustic image calculator 304 obtains head-related transfer functions from the memory 352 which has stored a head-related transfer function from each loudspeaker to the left ear of the user 251 and a head-related transfer function from each loudspeaker to the right ear of the user 251. Also, the virtual acoustic image calculator 304 sets a virtual acoustic image based on the arrangement of the loudspeakers 206, 207, and 208, and calculates a head-related transfer function from a virtual sound source loudspeaker assumed to realize the virtual acoustic image to the left ear of the user 251 and a head-related transfer function from the virtual sound source loudspeaker to the right ear of the user 251. The virtual acoustic image calculator 304 then calculates a second relational expression established between the respective acoustic filter coefficients of the acoustic filters 202, 203, and 204, based on these four types of head-related transfer functions.

The essential content of the second relational expression has the same meaning as that of the above-mentioned content. However, in the complex sound pressure ratio between both ears of the user 251, the second relational expression is obtained by matching a first sound pressure ratio based on a synthetic sound of sounds emitted from the loudspeakers 206, 207, and 208 with a second sound pressure ratio based on a virtual sound source which is based on the assumption that there is a virtual sound source of a virtual acoustic image to be determined based on an incoming direction of the synthetic sound. In this case, the virtual acoustic image calculator 304 sets the first sound pressure ratio so as to agree with the second sound pressure ratio based on the virtual acoustic image.

The acoustic filter coefficient setting unit 305 obtains at least one or more acoustic filter coefficients set by the acoustic filter setting unit 302 and the first and second relational expressions, obtains acoustic filter coefficients of the respective acoustic filters 202, 203, and 204 by calculations, and sets these acoustic filter coefficients to respective acoustic filters 353. In the example shown in the present embodiment, the acoustic filter 353 in FIG. 3 corresponds to the acoustic filters 202, 203, and 204.

<Other>

Operations of the control device 205 will be described in detail in the next operational example. It should be noted that in the present embodiment, the control of the control device 205 may be achieved by a general-purpose CPU. However, part or all of the operations (or functions) may be achieved by one or more dedicated processors. With respect to the configuration of the control device 205, various omissions, substitutions, and additions may be made in accordance with an embodiment.

Operational Example

Next, the outline of an operation of the control device 205 will be described using FIG. 4.

Figure 4:
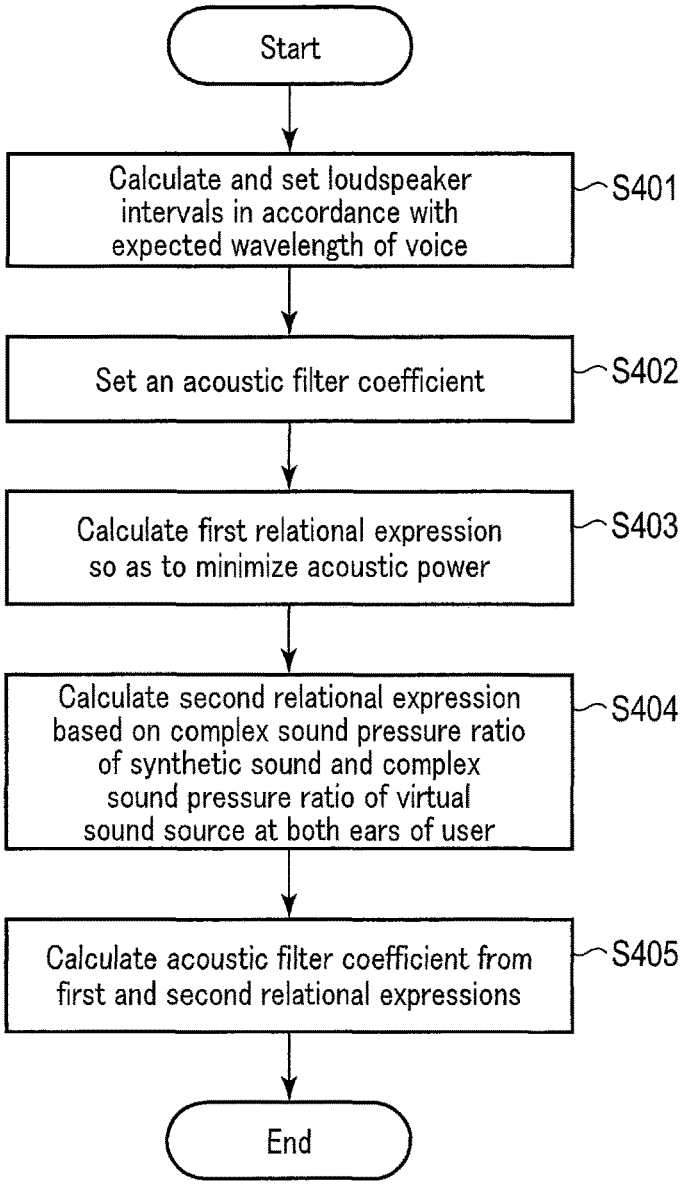
FIG. 4 is a flowchart schematically showing an example of processing procedure of the acoustic control apparatus according to the first embodiment.

FIG. 4 is a flowchart illustrating an example of the processing procedure of the control device 205. It should be noted that the processing procedure explained below is merely an example, and each processing may be modified as much as possible. Also, a step or steps may be omitted from, replaced by, and/or added to the processing procedure explained below in accordance with an embodiment.

(Start-Up)

First, a user, etc. starts a control device 205 via an input device 1606, etc. to be described later and further accepts input, such as settings. The control device 205 proceeds with processing in accordance with the following processing procedure.

(Step S401)

In step S401, an acoustic power minimization calculator 303 obtains wavelengths of expected sounds from an input device 1606, determines corresponding wavenumbers, calculates allowable loudspeaker intervals of loudspeakers 206, 207, and 208, and sets the intervals of the loudspeakers. With respect to the calculation result in the step S401, a result calculated by the acoustic power minimization calculator 303 may be stored in a memory 352 in advance, and the intervals of the loudspeakers may be set based on the result data.

(Step S402)

In step S402, an acoustic filter setting unit 302 sets at least one acoustic filter coefficient to a predetermined factor (e.g., a gain function for a frequency). For example, the acoustic filter setting unit 302 sets an acoustic filter coefficient to 1. In an acoustic filter having an acoustic filter coefficient of 1, a sound signal to be input is equal to a sound signal to be output, which is equal to performing an identity calculation for the input signal.

(Step S403)

In step S403, the acoustic power minimization calculator 303 receives sound signals, obtains wavenumber information of sounds, performs a calculation for minimizing the acoustic power, based on the wavenumber information and the data of loudspeaker intervals obtained in step S401, and calculates a first relational expression established between acoustic filter coefficients other than the acoustic filter coefficient set in step S402.

(Step S404)

In step S404, a virtual acoustic image calculator 304 calculates a second relational expression established between the acoustic filter coefficients other than the acoustic filter coefficient set in step S402, based on a first sound pressure ratio of a synthetic sound of sounds emitted from the loudspeakers and a second sound pressure ratio of virtual sound sources of a virtual acoustic image determined based on the incoming direction of the synthetic sound, in a complex sound pressure ratio between the ears of the user 251.

The virtual acoustic image calculator 304 may be configured to calculate the second relational expression established between the acoustic filter coefficients, based on a head-related transfer function between a loudspeaker and the user and a head-related transfer function between a virtual sound source and the user.

(Step S405)

In step S405, the acoustic filter coefficient setting unit 305 calculates an acoustic filter coefficient from the first relational expression obtained in step S403 and the second relational expression obtained in step S404.

The acoustic filter coefficients of all of the acoustic filters can be determined through the above-mentioned steps.

Figure 5:
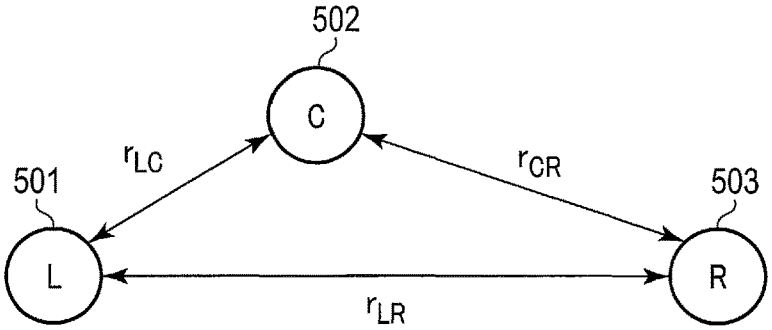
FIG. 5 is a view illustrating acoustic power minimization.

Next, the calculation method of the acoustic power minimization calculator 303 will be described with reference to FIG. 5. FIG. 5 is a view for explaining the intervals of sound sources used in the calculation of the acoustic power minimization calculator 303.

An acoustic power W when there are a plurality of sound sources is expressed by the following equation. Here, a case will be described where loudspeakers 501, 502, and 503 as three sound sources are arranged as shown in FIG. 5.

$$W = \frac{\omega\rho k}{8\pi} \left\{ q_L q_L^* + \frac{\sin(kr_{CL})}{kr_{CL}} q_C q_L^* + \frac{\sin(kr_{RL})}{kr_{RL}} q_R q_L^* + \frac{\sin(kr_{LC})}{kr_{LC}} q_L q_C^* + q_C q_C^* + \frac{\sin(kr_{RC})}{kr_{RC}} q_R q_C^* + \frac{\sin(kr_{LR})}{kr_{LR}} q_L q_R^* + \frac{\sin(kr_{CR})}{kr_{CR}} q_C q_R^* + q_R q_R^* \right\} \quad (1)$$

where, ω denotes the number of vibrations of a sound wave; ρ denotes a density of a medium; κ denotes a wavenumber of the sound wave; $q_L$, $q_C$, and $q_R$ each denote a complex volume velocity of a corresponding sound source; and $r_{LC}$, $r_{CR}$, and $r_{RL}$, etc. each denote a distance between the sound sources indicated by a suffix. Also, "*" denotes a complex conjugate. It should be noted that the unit of the acoustic power is, for example, W, and the unit of the complex volume velocity is, for example, $m^3/s$. As can be seen from the unit, the acoustic power indicates the energy of sounds per unit time. The acoustic power is an absolute value determined by sound sources and does not depend on a position from the sound sources. The complex volume velocity indicates a proportion of the volume of a sound when the sound passes through a plane within an acoustic field. In the acoustic control apparatus of the present embodiment, the medium is typically air. $q_L$, $q_C$, and $q_R$ denote complex volume velocities of the sound sources L, C, and R, respectively.

The calculation performed by the acoustic minimization calculator 303 in the present embodiment is to derive a first relational expression which is established between a plurality of complex volume velocities in the case of minimizing W, using the complex volume velocities as variables, under the condition where physical quantities related to the sound sources, such as ω, ρ, κ, $r_{LC}$, $r_{CR}$, and $r_{RL}$, and the distance between the sound sources is initialized with default in accordance with the setting and the environment of the acoustic control apparatus. With the above equation (1), the acoustic power minimization calculator 303 is to derive a first relational expression established among three complex volume velocities $q_L$, $q_C$, and $q_R$. These complex volume velocities are equal to acoustic filter coefficients of the corresponding loudspeakers, respectively.

Figure 6:
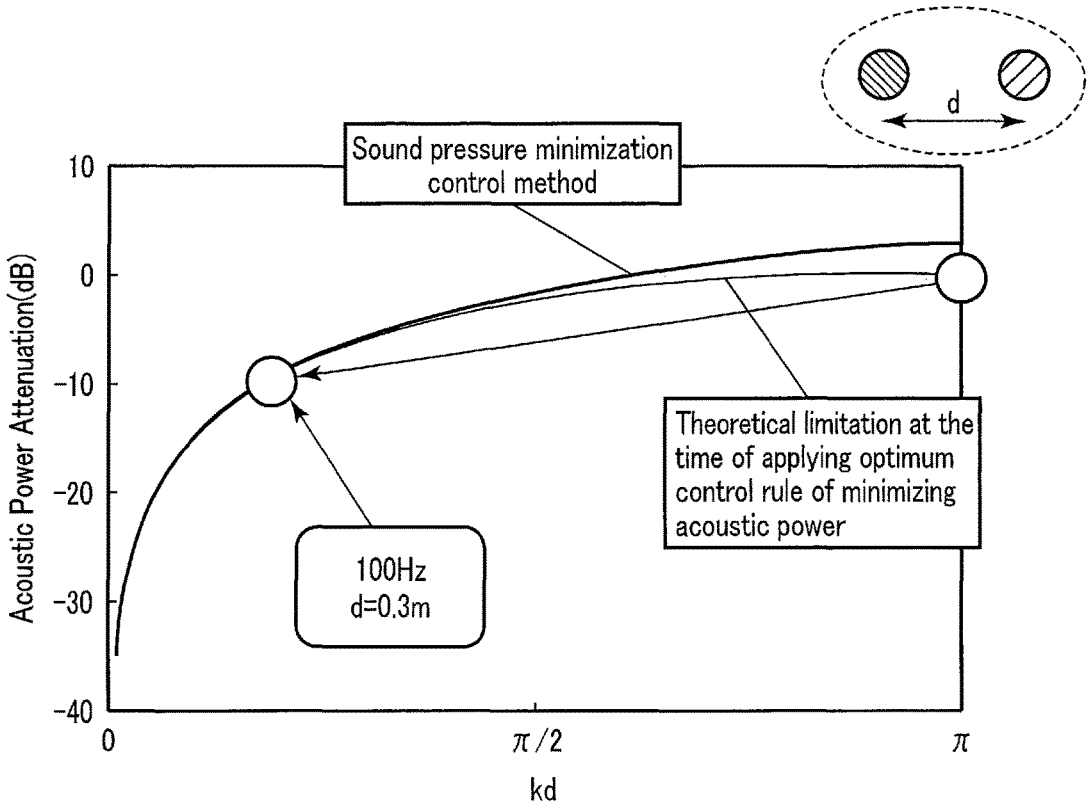
FIG. 6 is a graph for illustrating a theoretical limitation for reducing the acoustic power.

Next, the acoustic power minimization involves a theoretical limitation of reducing the acoustic power, which will be described with reference to FIG. 6. FIG. 6 is a view for illustrating that there is a limitation of reducing the acoustic power in the case where two sound sources are arranged in a free space. Here, the two sound sources will be described; however, generally, it is possible to develop essentially the same discussion also in the case where three or more sound sources are arranged.

The vertical axis shown in FIG. 6 indicates reduction levels (i.e., acoustic power attenuation) of reducing the acoustic power, and the horizontal axis indicates a product kd (i.e., acoustic power reducing limitation index) between a wavenumber k of a sound source and a distance d of the sound source. According to the graph shown in FIG. 6, it is understood that when the interval of the sound sources is 0.3 m, it is impossible to reduce the acoustic power of the sound with a frequency of 566 Hz. Also, according to the graph, it is understood that in order to reduce the acoustic power by just only 10 dB in the case where d=0.3 m, it needs only to shift the frequencies of the sounds to 100 Hz. Therefore, it is possible to reduce the acoustic power of the sound by shifting frequency components of the sound to lower frequencies through acoustic filters. Here, the case where two sound sources are arranged is described for simplification; however, even in a case where three or more sound sources are arranged, a graph as shown in FIG. 6 can be obtained by extending the case where two sound sources are arranged. For this reason, the acoustic control apparatus of the present embodiment can determine whether or not the conditions for minimizing the acoustic power are met.

Figure 7:
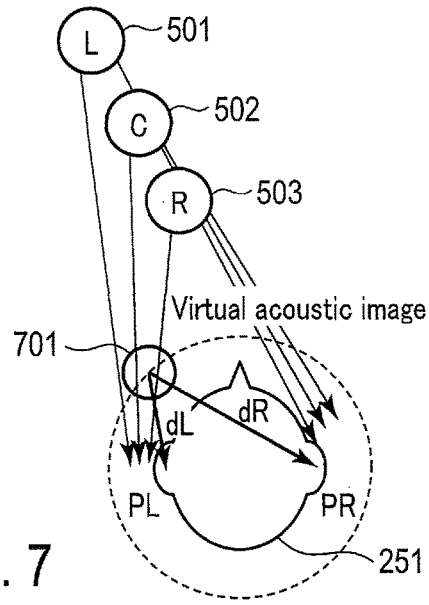
FIG. 7 is a view showing a relationship between the arrangement of three sound sources and the position of a virtual acoustic image the user is listening to in the acoustic control apparatus according to the embodiment.

Next, calculations performed by the virtual acoustic image calculator 304 will be described with reference to FIG. 7. FIG. 7 is a view for illustrating a positional relationship between sound sources and a virtual acoustic image when the virtual acoustic image is set. Furthermore, FIG. 7 also shows what kind of arrangement of the sound sources is suitable for maximizing the effect of the acoustic control.

The virtual acoustic image can be set in a particular direction as viewed from the user 251. It turned out by way of experiments that when in the acoustic control apparatus of the present embodiment, the direction of the virtual acoustic image is matched with the incoming directions of sounds from sound sources, and the sound sources are arranged as shown in FIG. 7, it allows the user 251 to hear the sounds well in a region where the user 251 resides, and it is possible, in regions other than the region, to maximize the degree of making it difficult to hear the sounds. As shown in FIG. 7, the loudspeakers 501, 502, and 503 are arranged at different distances as viewed from the user 251, respectively. That is, the same wave surface from the respective loudspeakers 501, 502, and 503 has arrived at the user 251 at different points of time.

As a result, in the present embodiment, if the positions at which the loudspeakers 501, 502, and 503 are arranged and the position of the user 251 are determined, then the direction of the virtual acoustic image viewed from the user 251 is also determined. Furthermore, if the head-related transfer functions from the position of the virtual acoustic image (i.e., the position of the virtual sound source) from the user 251 to both ears of the user 251 is determined, then it is possible to obtain, in the complex sound pressure ratio between both ears of the user 251, a second relational expression related to the acoustic filter coefficients by matching a first sound pressure ratio based on a synthetic sound of sounds emitted from the loudspeakers 501, 502, and 503 with a second sound pressure ratio based on virtual sound sources, assuming that the virtual sound sources of the virtual acoustic image are present in a direction in agreement with the incoming direction of the synthetic sound.

The present embodiment describes a case where three sound sources are arranged; however, the number of sound sources is extendible to N (N is a natural number of 2 or more). When N=2, there are two relational expressions. Therefore, two acoustic filter coefficients can be calculated uniquely. When N=3, there are three relational expressions. Therefore, if at least one of these acoustic filter coefficients is set, then the other acoustic filter coefficients can be calculated and determined uniquely by the two relational expressions. Generally, when N≥3, it suffices that (N−2) acoustic filter coefficients are set, and the other two acoustic filter coefficients are calculated by the two relational expressions.

According to the acoustic control apparatus of the first embodiment described above, the acoustic filter coefficient can be calculated by minimizing, in a complex sound pressure ratio between both ears of the user, the acoustic power from sound sources and matching a first sound pressure ratio based on a synthetic sound of sounds emitted from a plurality of sound sources with a second sound pressure ratio based on the sound virtual sound sources, assuming that the virtual sound sources of a virtual acoustic image are present in the incoming direction of the synthetic sound. When the acoustic filter coefficients are used for acoustic filers, it is possible to make it difficult to hear sounds in regions other than a particular region.

Second Embodiment

Figure 8:
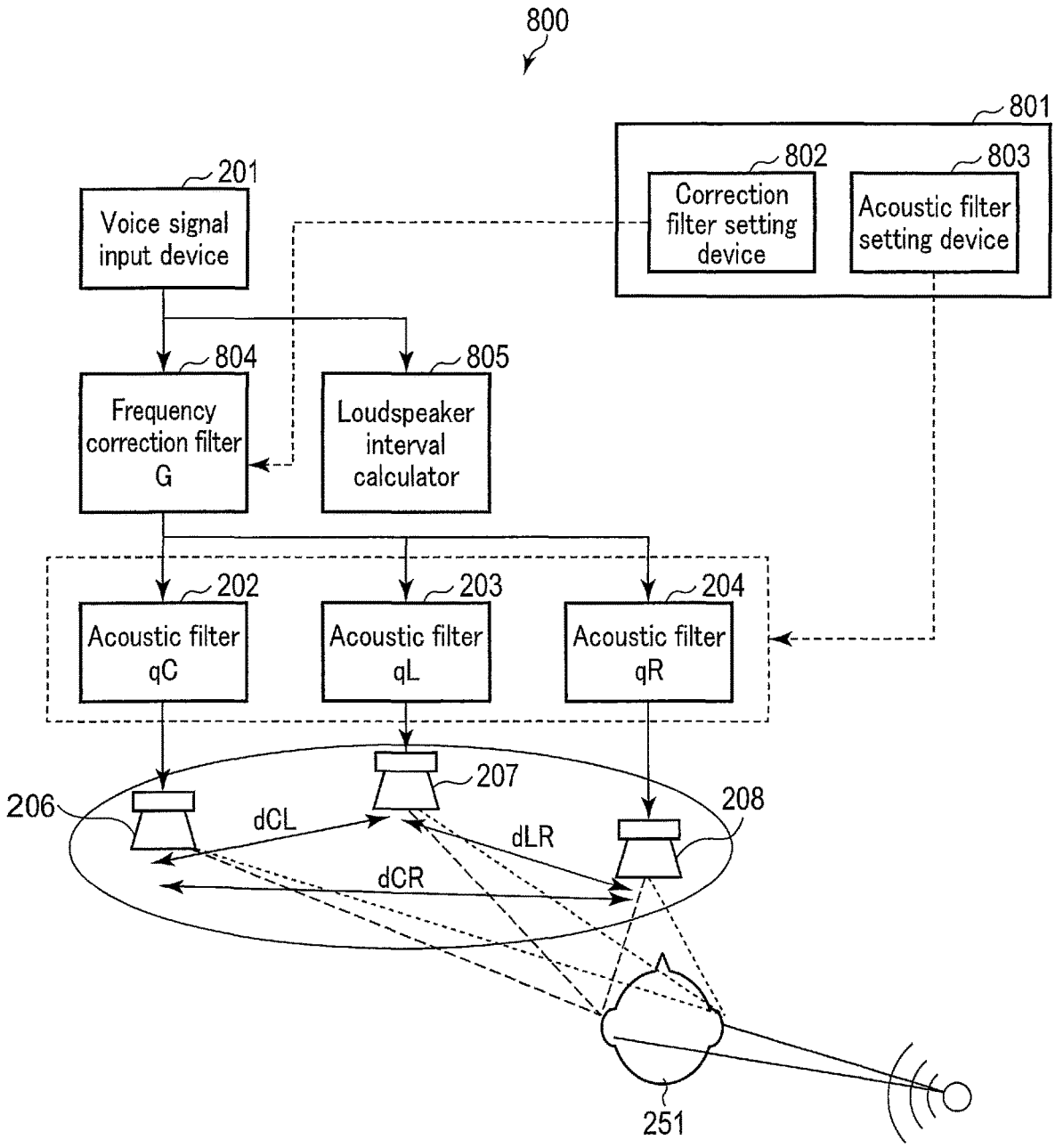
FIG. 8 is a schematic block view showing an example of the acoustic control apparatus according to the second embodiment.

The acoustic control apparatus according to the present embodiment will be described with reference to FIG. 8. FIG. 8 is a schematic block view showing an example of the acoustic control apparatus according to the present embodiment.

The acoustic control apparatus of the present embodiment includes a voice signal input device 201, acoustic filters 202, 203, and 204, a control device 801, loudspeakers 206, 207, and 208, a frequency correction filter G 804, and a loudspeaker interval calculator 805. The control device 801 includes a correction filter setting device 802 and an acoustic filter setting device 803.

The correction filter setting device 802 calculates setting values for correcting the frequency characteristics of the voice signals input in the acoustic filters 202, 203, and 204 and gives the calculated setting values to the frequency correction filter G 804. The correction filter setting device 802 calculates, for example, setting values for shifting the voice signals to be input to the acoustic filters 202, 203, and 204 to lower frequencies.

The acoustic filter setting device 803 calculates a plurality of relational expressions established between acoustic filters in accordance with preset calculation rules and further sets one or more acoustic filters depending on the number of loudspeakers to thereby set acoustic filters based on the relational expressions. Some of the relational expressions may be obtained according to the minimization of the acoustic power, virtual acoustic image reproduction, or minimization of the acoustic energy, for example.

The frequency correction filter G 804 changes the frequency characteristics of the voice signals from the voice signal input device 201 in accordance with the setting values set by the correction filter setting device 802.

The loudspeaker interval calculator 805 calculates three intervals which are distances between the respective loudspeakers 206, 207, and 208. The intervals can be determined based on typical frequencies of the voice signals and how much degree of the acoustic power level should be reduced.

<Control Device 801 of Acoustic Control Apparatus>

Figure 9:
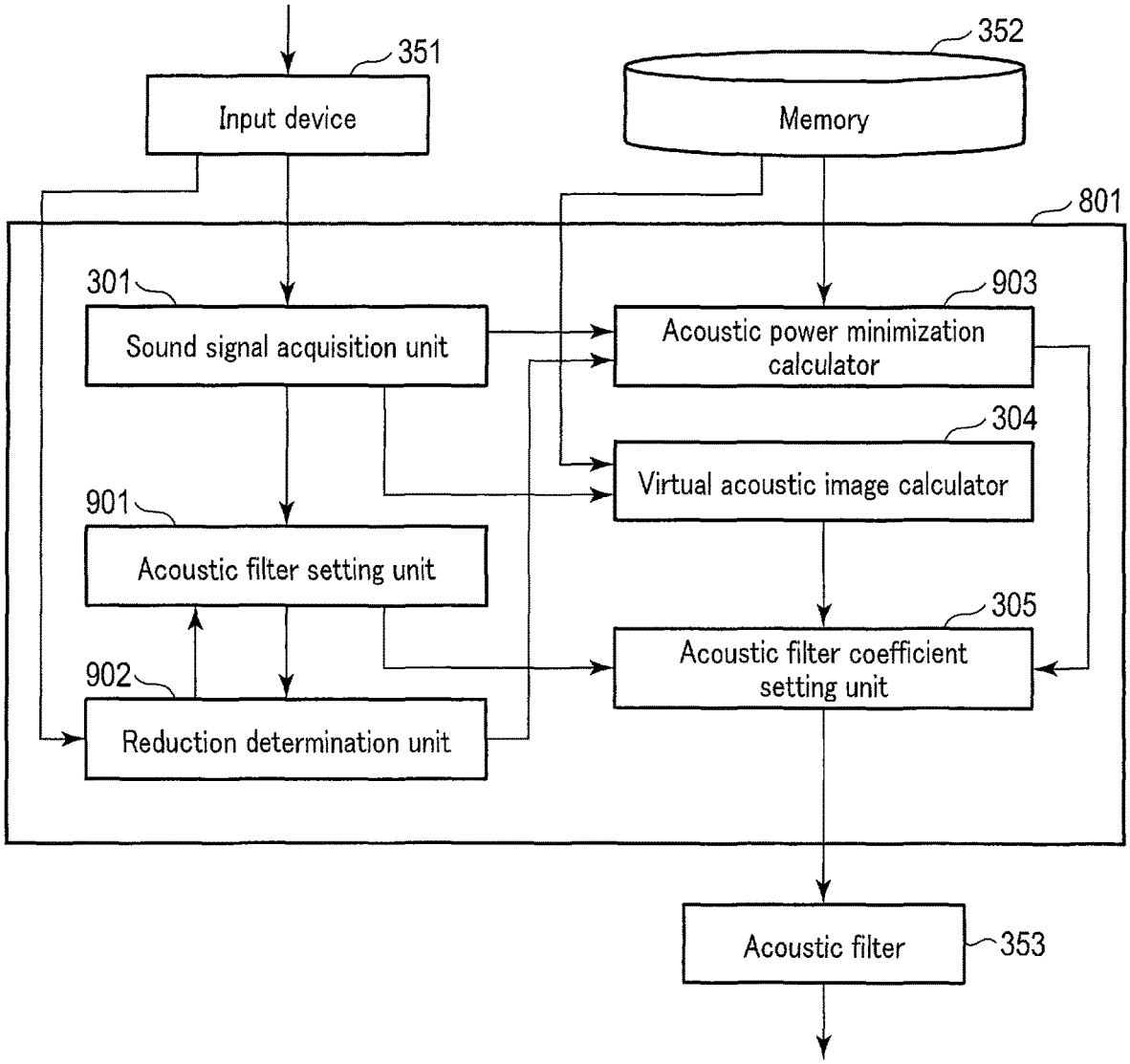
FIG. 9 is a view mainly showing an example of a control device of FIG. 8.

Next, the control device 801 included in the acoustic control apparatus shown in FIG. 8 will be described with reference to FIG. 9. FIG. 9 is a functional block view showing elements included in the control device of the acoustic control apparatus according to the second embodiment.

The control device 801 includes a sound signal acquisition unit 301, an acoustic filter setting unit 901, a reduction determination unit 902, an acoustic power minimization calculator 903, a virtual acoustic image calculator 304, and an acoustic filter coefficient setting unit 305.

The acoustic filter setting unit 901 corrects all of the acoustic filters 202, 203, and 204. The acoustic filter setting unit 901 preliminarily determines correction values such that the frequency characteristics are shifted to lower frequencies. Also, the acoustic filter setting unit 901 may be configured to correct only at least one filter out of the acoustic filters 202, 203, and 204. Furthermore, the acoustic filter setting unit 901 determines acoustic filter coefficients depending on the number of loudspeakers, similarly to the acoustic filter setting unit 302.

The reduction determination unit 902 obtains frequency information related to the sound signals from the input device 351 and obtains wavenumber information as a result. Also, the reduction determination unit 902 obtains interval information calculated by the loudspeaker interval calculator 805 from the input device 351 or memory 352. Furthermore, the reduction determination unit 902 can determine the frequency characteristics of the acoustic filters through acoustic filters set by the acoustic filter setting unit 901. For this reason, the reduction determination unit 902 can determine whether the reduction amount for reducing the acoustic power depending on a sound signal is within an allowable range. When the reduction determination unit 902 determines that the reduction amount is not within the allowable range, the reduction determination unit 902 gives an instruction signal to the acoustic filter setting unit 901 so as to change the frequency characteristics of the acoustic filters. Specifically, when the reduction determination unit 902 determines that the reduction amount is small, it instructs the acoustic filter setting unit 901 to shift the frequency characteristics of the acoustic filters to lower frequency side.

When the reduction determination unit 902 determines that the reduction amount of the acoustic power is within the allowable range, the acoustic power minimization calculator 903 obtains the frequency information of the sound signals from the sound signal acquisition unit 301, and the loudspeaker intervals from the memory 352 to thereby calculate a first relational expression established between the acoustic filters.

Operational Example

Next, the outline of the operation of the control device 801 will be described using FIG. 10.

Figure 10:
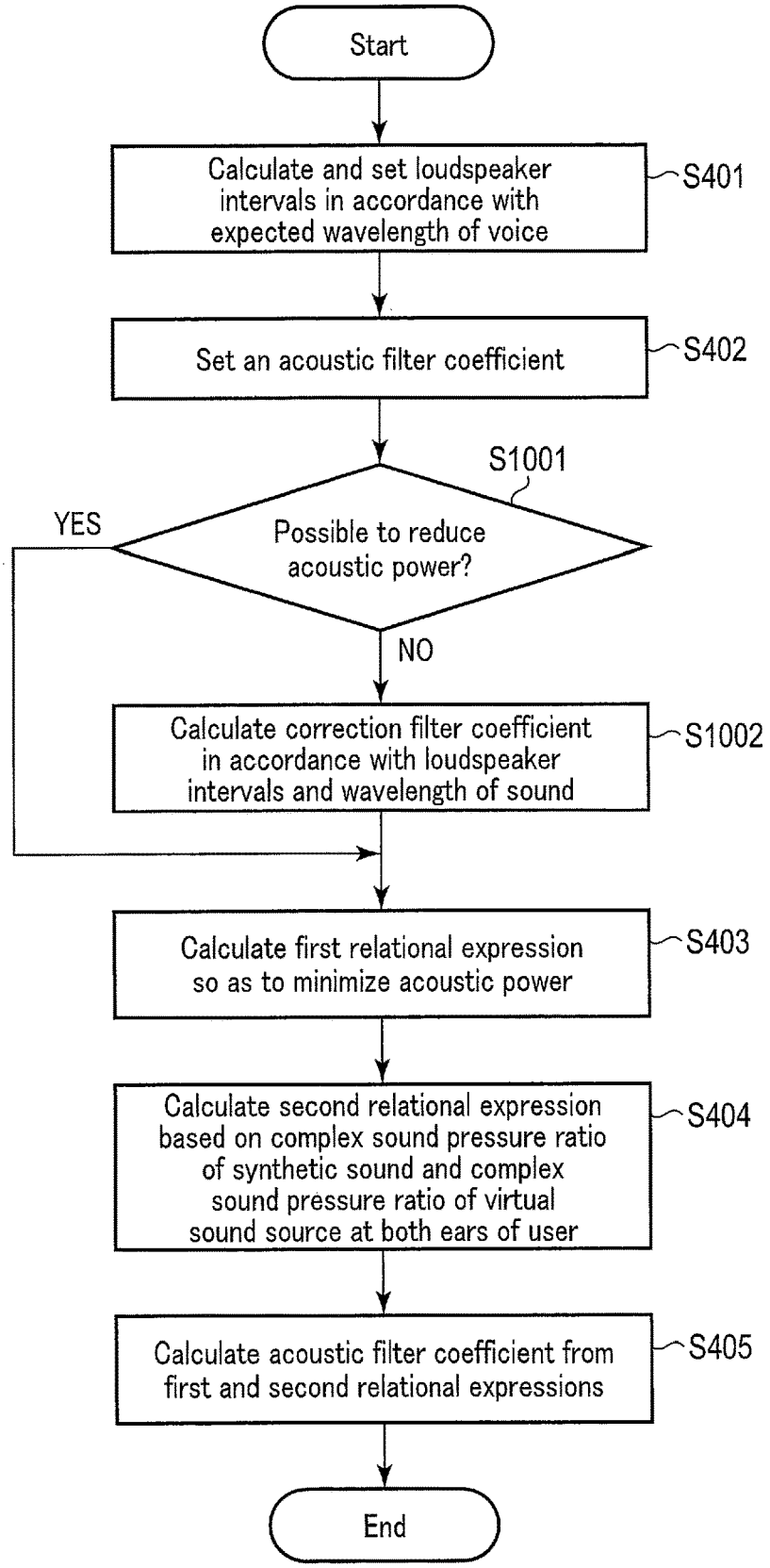
FIG. 10 is a flowchart schematically sowing an example of the processing procedure of the acoustic control apparatus according to the second embodiment.

FIG. 10 is a flowchart illustrating an example of the processing procedure of the control device 801. It should be noted that the processing procedure described below is merely an example, and each processing may be modified as much as possible. Furthermore, various omissions, substitutions and additions may be made suitably to the processing procedure described below in accordance with an embodiment.

(Start-Up)

First, a user, etc. starts a control device 801 via an input device 1606, etc. to be described later and further accepts input such as settings, etc. The control device 801 proceeds with the processing in accordance with the following processing procedure.

In step S401, the acoustic power minimization calculator 303 may be configured to calculate the intervals of a plurality of loudspeakers; however, the loudspeaker interval calculator 805 may be configured to calculate these intervals in advance.

In step S402, the acoustic filter setting unit 901 sets acoustic filter coefficients.

(Step S1001)

In step S1001, the reduction determination unit 902 determines whether or not the acoustic power can be reduced to a desired level (or whether or not the acoustic power can be reduced to a level within an allowable range), and when it determines the reduction is possible, the processing proceeds to step S403, and when it determines that the acoustic power cannot be reduced, the processing proceeds to step S1002.

(Step S1002)

In step S1002, the acoustic filter setting unit 901 calculates correction filter coefficients based on the wavelengths of sounds (i.e., wavenumbers) obtained from the frequency information of sound signals, and loudspeaker intervals calculated by the loudspeaker interval calculator 805. The correction filter coefficients are for shifting the frequency characteristics of the acoustic filters to the lower frequency side.

In step S403, the acoustic power minimization calculator 903 performs the calculation for minimizing the acoustic power, from the wavenumber information of the sound signals and the loudspeaker intervals to thereby calculate a first relational expression.

Finally, in step S405, acoustic filter coefficients of all of the acoustic filters can be calculated from the two relational expressions and the acoustic filter coefficients preset based on the number of loudspeakers.

Figure 11:
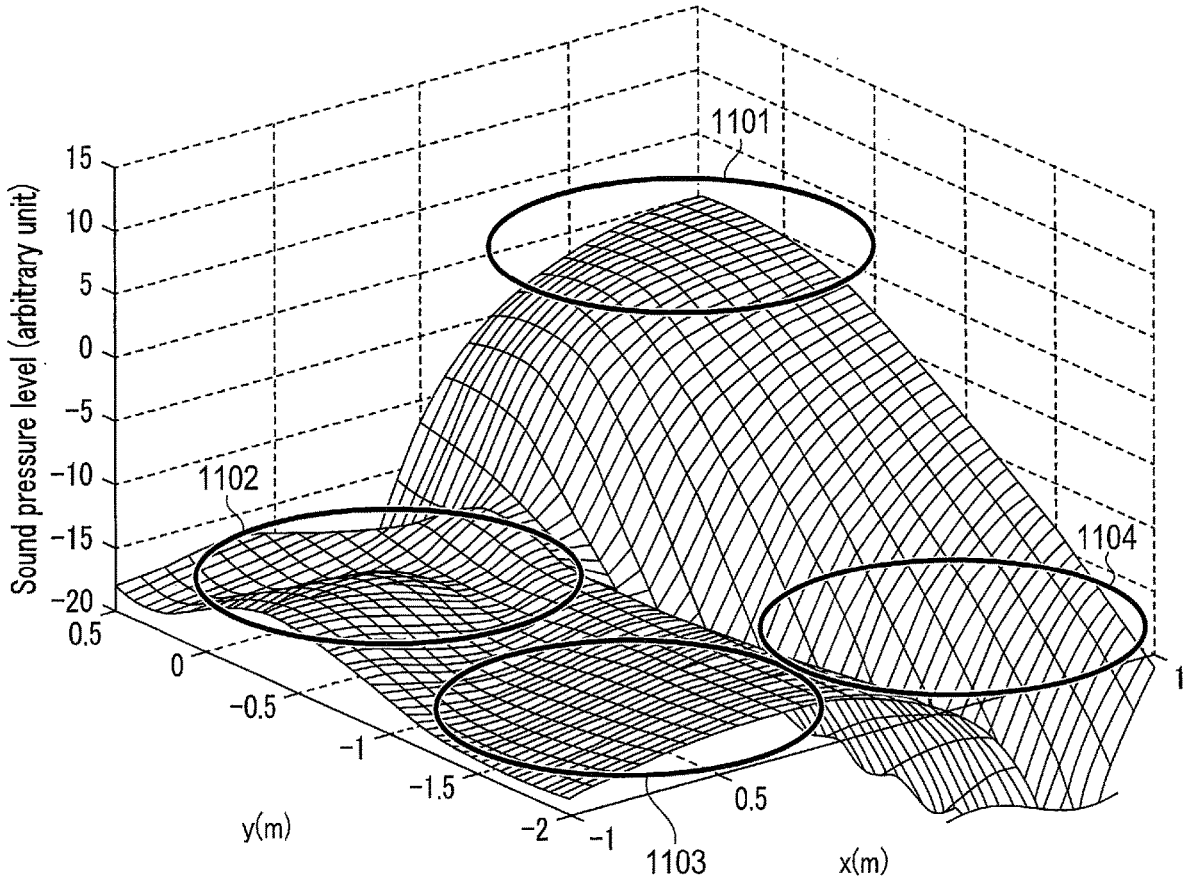
FIG. 11 is a view showing an example of the sound pressure levels of the acoustic control apparatus according to the first and second embodiments in a space including four seats shown in FIG. 1.

Next, a distribution of sound pressure levels in a space achieved by the acoustic control apparatus according to the second embodiment will be described with reference to FIG. 11. FIG. 11 is a view showing an example of the sound pressure levels achieved, in a space including the four seats shown in FIG. 1, by the acoustic control apparatus according to the first and second embodiments.

The four regions 1101, 1102, 1103, and 1104 shown in FIG. 11 correspond to a driver seat, a passenger seat, a rear left seat (i.e., a VIP seat), and a rear right seat (a seat right behind the driver), respectively. A user 251 takes a seat at the region 1101. According to the distribution shown in FIG. 11, it is understood that the region 1101 has acoustic power of the highest level, and sounds of sufficient acoustic power are emitted in this region. Therefore, it is assumed that the user 251 can obtain information necessary for the user, included in sound signals, by the sufficient acoustic power in an assured manner. On the other hand, in the regions 1102, 1103, and 1104 other than the region 1101, the acoustic power levels become remarkably low values as compared to the acoustic power level in the region 1101. Therefore, it is understood that in these regions 102, 1103, and 1104, sounds emitted by the loudspeakers are very little, and these regions are quiet regions as a whole. Therefore, it is understood that the acoustic control apparatus according to the first and second embodiments can make it difficult to here sounds in regions other than a particular region. Furthermore, an acoustic control apparatus to be shown later in the third embodiment can provide a tranquil space in a particular space. The acoustic control apparatus according to the third embodiment can also obtain a distribution similar to that shown in FIG. 11. In the third embodiment, the acoustic energy of a small region, such as the region 1103, can be minimized.

The acoustic power level distribution shown in FIG. 11 can also be achieved even by the first embodiment, if the frequencies of sound signals and the loudspeaker intervals are optimal for the acoustic power minimization.

The acoustic control apparatus according to the second embodiment described above determines whether or not the loudspeaker intervals are sound source intervals optimal for minimizing the acoustic power, based on the wavenumbers of sounds emitted from the loudspeakers, in addition to the effect of the first embodiment, and if the loudspeaker intervals are not optimal, it changes the acoustic filter coefficients to shift the frequencies of the sounds emitted to lower frequencies. As a result, the acoustic control apparatus according to the present embodiment can achieve the acoustic power minimization, even under a situation where the acoustic power minimization cannot be achieved by the acoustic control apparatus of the first embodiment. Therefore, the acoustic control apparatus of the second embodiment can make it difficult to hear sounds in regions other than a particular region by shifting the frequencies to lower frequencies and then using optimized acoustic filter coefficients for the acoustic filters, in situations more than in the first embodiment.

Third Embodiment

Figure 12:
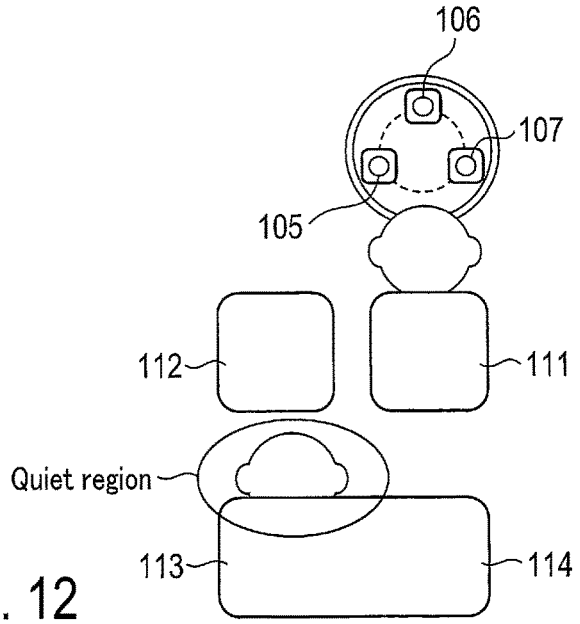
FIG. 12 is a view showing an example of the effect brought about by the acoustic control apparatus according to the third embodiment.

The outline of the acoustic control apparatus of the present embodiment will be described with reference to FIGS. 1 and 12. The acoustic control apparatus of the present embodiment includes the same elements as those shown in FIG. 1. FIG. 12 shows a typical effect of the acoustic control apparatus of the third embodiment. The acoustic control apparatus of the present embodiment includes elements for achieving the minimization of the acoustic energy in a particular region. As a typical example, an in-car sound environment of an automobile on which a car navigation system has been mounted is assumed. In this case, it is essential, in a driver region 111, for the driver to hear a voice from the car navigation system. On the other hand, it is preferable for a user in a VIP seat region 113 to hear the voice from the car navigation system as little as possible. The acoustic control apparatus of the present embodiment is provided to achieve enabling the user 251 at the driver seat 111 to hear voices and minimize the acoustic energy as much as possible for a person who has taken the VIP seat region 113 which is a rear seat of the driver seat.

Next, a control device 1300 of the acoustic control apparatus of the present embodiment will be described. The control device 1300 is installed to operate, instead of the control device 205 shown in FIG. 2 or the control device 801 shown in FIG. 8.

<Control Device 1300 of Acoustic Control Apparatus>

Figure 13:
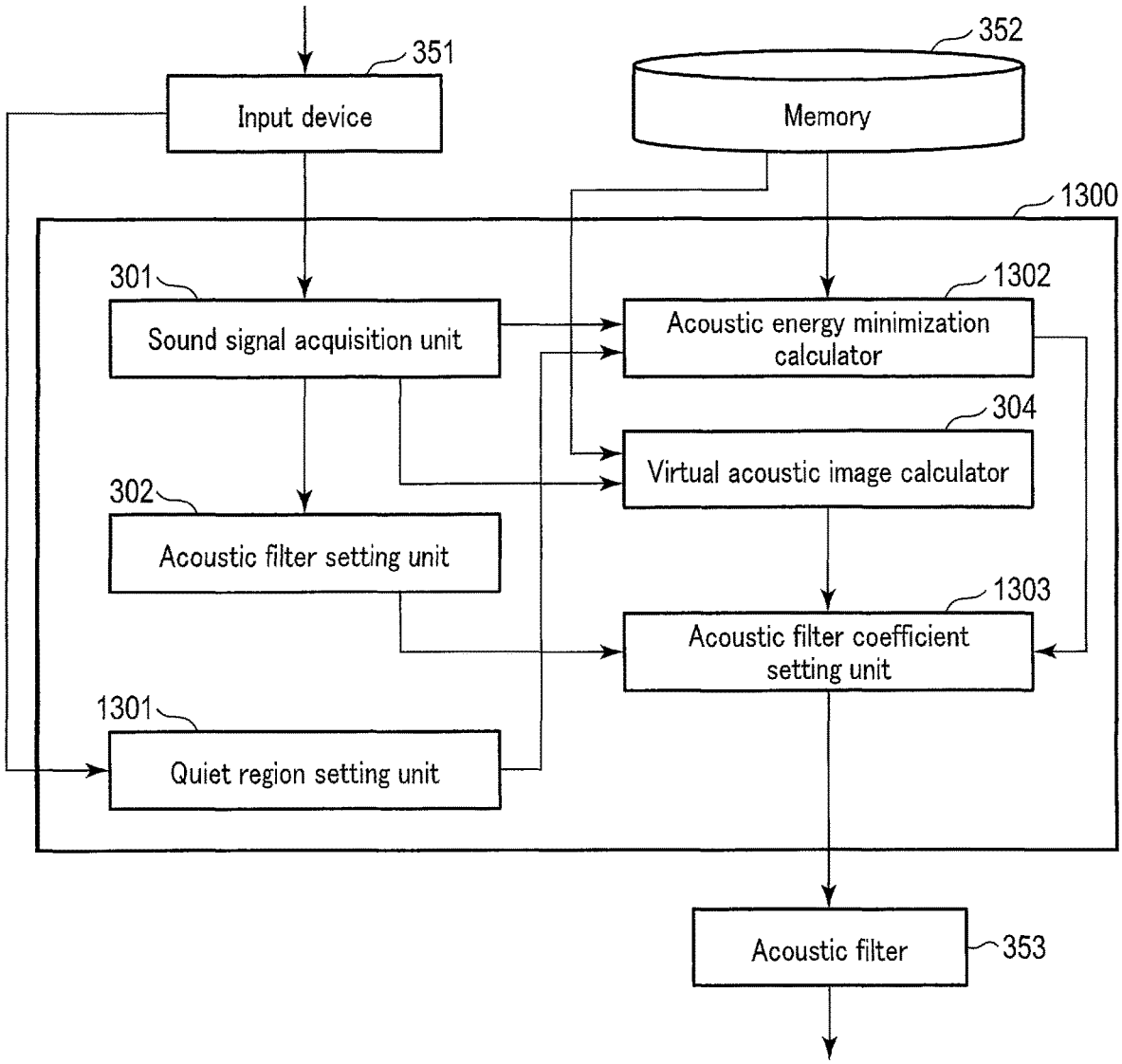
FIG. 13 is a view mainly showing an example of a control device of the acoustic control apparatus according to the third embodiment.

Next, the control device 1300 included in the acoustic control apparatus of the present embodiment will be described with reference to FIG. 13. FIG. 13 is a functional block view showing elements included in the control device 1300.

The control device 1300 includes a sound signal acquisition unit 301, an acoustic filter setting unit 302, a quiet region setting unit 1301, an acoustic energy minimization calculator 1302, a virtual acoustic image calculator 304, and an acoustic filter coefficient setting unit 1303.

The quiet region setting unit 1301 sets a quiet region which is a region desired to be made a quiet environment and designated by an input device 351. In the case of the interior of an automobile, the quiet region is, for example, a VIP seat region 113.

The acoustic energy minimization calculator 1302 obtains a sound signal from the sound signal acquisition unit 301 and calculates a first relational expression established between acoustic filter coefficients allowing the minimization of the acoustic energy in the quiet region designated by the quiet region setting unit 1301. The calculation for the minimization performed by the acoustic energy minimization calculator 1302 will be described later with reference to FIG. 15. It should be noted that the first relational expression obtained by the acoustic control apparatus of the third embodiment differs from the first relational expression obtained in the first and second embodiments.

The acoustic filter coefficient setting unit 1303 calculates an acoustic filter coefficient based on the first relational expression calculated by the acoustic energy minimization calculator 1302 and the second relational expression calculated by the virtual acoustic image calculator 304 and sets the calculated acoustic filter coefficient at an acoustic filter 353.

Operational Example

Next, the outline of the operations of the control device 1300 will be described using FIG. 14.

Figure 14:
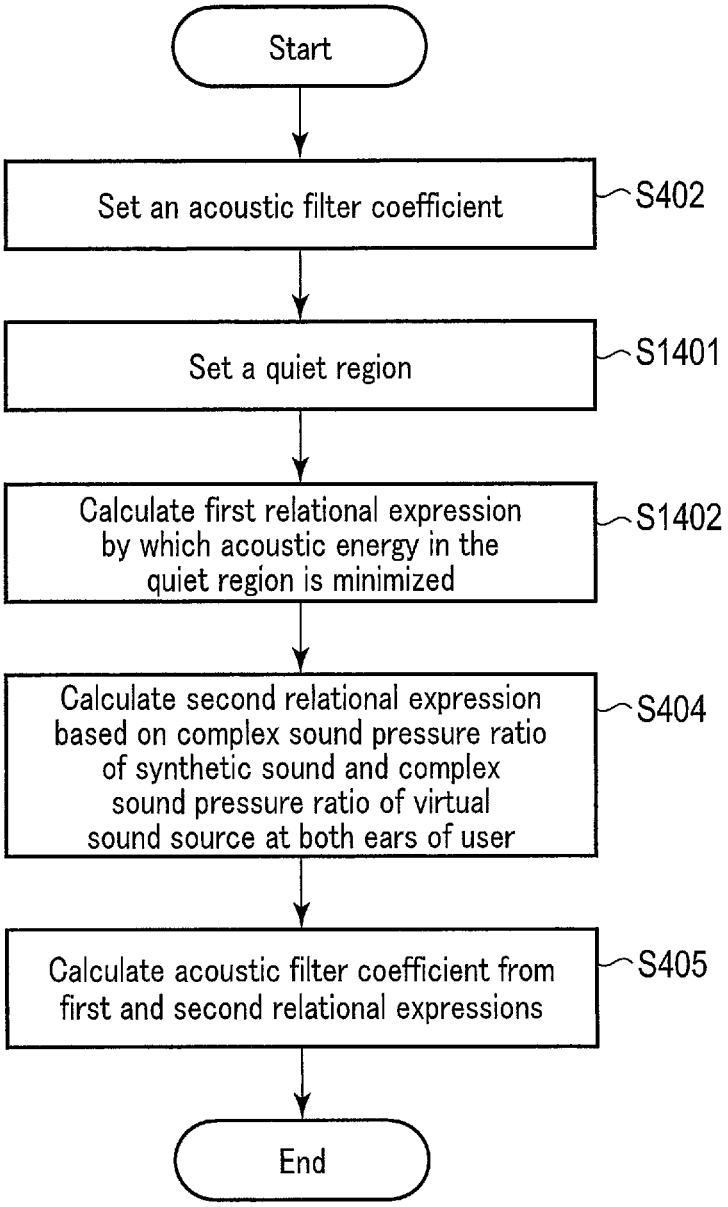
FIG. 14 is a flowchart schematically showing an example of the processing procedure of the acoustic control apparatus according to the third embodiment.

FIG. 14 is a flowchart illustrating an example of the processing procedure of the control device 1300. It should be noted that the processing procedure described below is merely an example, and each processing may be modified as much as possible. Furthermore, various omissions, substitutions and additions may be made suitably to the processing procedure described below in accordance with the embodiment.

(Start-Up)

First, a user, etc. starts a control device 1300 via an input device 1606, etc. to be described later and further accepts input such as settings, etc. The control device 1300 proceeds with the processing in accordance with the following processing procedure.

In step S402, an acoustic filter setting unit 302 sets at least one acoustic filter coefficient to a predetermined function (including also an identity calculation function). It should be noted that the acoustic filter to which an acoustic filter coefficient should be preliminarily set in this way depends on the number of sound sources, as descried above.

(Step S1401)

In step S1401, the quiet region setting unit 1301 sets, within an acoustic space, a quiet region in which the acoustic energy is desired to be minimized.

(Step S1402)

In step S1402, the acoustic energy minimization calculator 1302 performs a calculation, in the quiet region set in step S1402, so as to minimize the acoustic energy, and calculates a first relational expression established between a plurality of acoustic filter coefficients.

In step S404, the virtual acoustic image calculator 304 performs a calculation of the virtual acoustic image reproduction and calculates a second relational expression established Finally, in step S405, an acoustic filter coefficient setting unit 1303 calculates a plurality of acoustic filter coefficients based on the first relational expression calculated in step S1402, the second relational expression calculated in step S404, and the acoustic filter coefficient set in step S402.

Since acoustic filter coefficients of all of the acoustic filters can be determined through the above-mentioned steps, it is possible to set coefficients of all of the acoustic filters arranged in the acoustic control apparatus and realize a quiet region.

Figure 15:
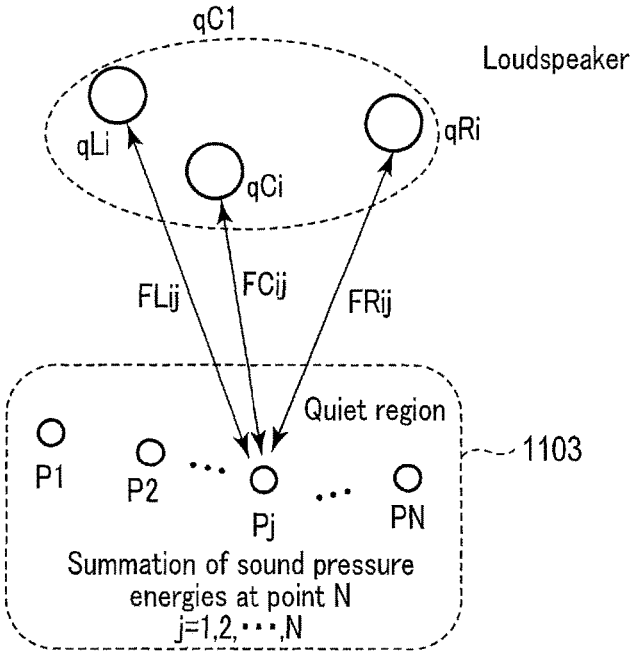
FIG. 15 is a view for illustrating the acoustic energy minimization of a particular region.

Next, the calculations performed by the acoustic energy minimization calculator 1302 will be described with reference to FIG. 15. FIG. 15 is a view for illustrating the summation of acoustic energies at a plurality of points included in a region that should be made to be a quiet region from the sound sources arranged.

In the acoustic energy minimization calculator 1302, the summation of acoustic energies conveyed to a plurality of sound-receiving positions j ($1 \leq j \leq N$; N is a natural number) within a quiet region that should be made quiet in which sound waves emitted from a group of sound sources at sound source positions i at a certain time t is represented by the following equation (2).

$$Q_i = \sum_{j=1}^{N} (p_j \cdot p_j^*) \tag{2}$$

It should be noted that $p_j$ denotes a sound pressure at a sound-receiving position i, and * denotes an operator of a complex conjugate. Also, $p_j$ is expressed by a head-related transfer function from the sound sources to the user 251 and a complex volume velocity of the sound sources. The acoustic energy minimization calculator 1302 determines a first relational expression which allows the minimization of the left side of the equation (2). The first relational expression becomes an equation showing a relationship between the acoustic filter coefficients of the acoustic filters connected to the respective sound sources.

The acoustic energy minimization calculator 1302 according to the third embodiment is characterized by being free from the reduction limitation based on the wavenumbers and the sound source intervals like the acoustic power minimization in the first and second embodiments. Therefore, if the acoustic energy minimization calculator 1302 completely interferes in the acoustic energies by the calculations by the acoustic energy minimization calculator 1302, then the sound pressure level in a local region can be minimized, theoretically. For this reason, in a quiet region calculated in the third embodiment, the sound pressure is likely to be drastically reduced than the sound pressure level of the corresponding region in the first and second embodiments.

According to the sound acoustic controller of the third embodiment described above, it is possible to determine, in a particular and desired region, a relational expression related to acoustic filter coefficients for minimizing the acoustic energy. Furthermore, in the third embodiment, since the reduction limitation in the first and second embodiments for the purpose of minimizing the acoustic energies is not present, sounds are highly likely to be made difficult to hear in a quiet region.

Configuration Example (Configuration of Hardware)

<Acoustic Control Apparatus>

Next, an example of the hardware configuration of the acoustic control apparatuses 200 and 800 according to the present application will be described using FIG. 16. It should be noted that the acoustic control apparatus of the third embodiment also has the same hardware configuration.

Figure 16:
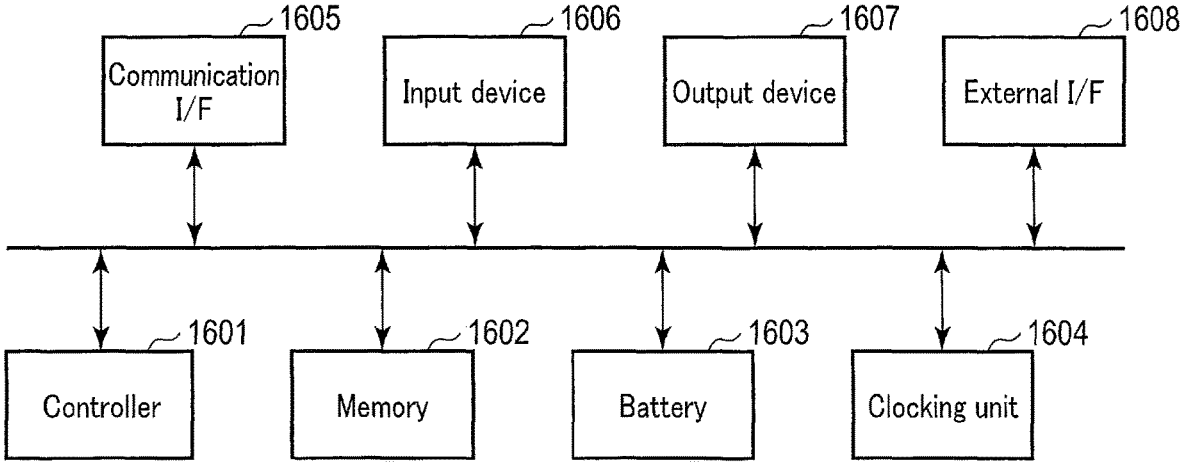
FIG. 16 is a view schematically showing an example of the hardware configuration of the acoustic control apparatus according to an embodiment.

As illustrated in FIG. 16, the acoustic control apparatus of the present embodiment includes a computer electrically connected to a controller 1601, a memory 1602, a battery 1603, a clocking unit 1604, a communication interface 1605, an input device 1606, an output device 1607, and an external interface 1608. In FIG. 16, the communication interface and the external interface are described as "Communication I/F" and "External I/F", respectively.

The controller 1601 includes a Central Processing Unit (CPU), a random Access Memory (RAM), and/or a Read Only Memory (ROM), etc., and controls respective configuration elements in accordance with information processing. The controller 1601 corresponds to the control device 205, control device 801, and control device 1300. Namely, the controller 1601 obtains voice signal information, sets an acoustic filter coefficient, performs a calculation for minimizing the acoustic power, a calculation of a virtual acoustic image reproduction, and/or a calculation for minimizing the acoustic energies, and executes a program for obtaining acoustic filter coefficients through a calculation. The program has been stored in the memory 1602, and the controller 1601 calls an execution program from the memory 1602.

The memory 1602 is a medium that stores information, such as a program, etc., by means of an electric, magnetic, optical, mechanical, or chemical action such that a computer, or the other device and equipment, etc. can read the information such as the recorded program, etc. The memory 1602 is an auxiliary storage device, for example, a hard disk drive, a solid state drive, or the like, and stores information on positions where sound sources are arranged, frequency information and phase information of the sound sources, data of a head-related transfer function (HRTF) between the sound source(s) and a certain region, and the above-mentioned program data.

In addition, the memory 1602 stores data, such as parameters related to acoustic filter coefficients and a virtual acoustic image, generated by a program executed by the controller 1601.

Furthermore, the memory 1602 may include a drive, and the drive is a device to accept stored data from an auxiliary memory device, a recording medium, etc., and in particular, read a program. The memory 1602 is, for example, a semiconductor memory drive (Flash Memory) drive), a Compact Disk (CD) drive, a Digital Versatile Disk (DVD) drive, etc. The type of the drive may be suitably selected in accordance with the type of the storage medium. Data, etc. obtained from the above execution program may be stored in the storage medium.

The battery 1603 may be any battery as far as it can supply power to the acoustic control apparatus and/or apparatus parts included in a device which includes the acoustic control apparatus, and is, for example, a chargeable secondary battery or an alternating battery capable of acquiring power from a common consent. The battery 1603 supplies the power to various elements mounted on the main body of the acoustic control apparatus and/or a device which includes the acoustic control apparatus. The battery 1603 supplies the power to the controller 1601, the memory 1602, the clocking unit 1604, the communication interface 1605, the input device 1606, the output device 1607, and the external interface 1608, for example.

The clocking unit 1604 is a device measuring time and is able to measure time and date. For example, the clocking unit 1604 may be a clock including a calendar to give information on year and month and/or time and date at the present time to the controller 1601. The clocking unit 1604 is used to provide time and date, for example, at the time of generating acoustic source data, etc., related to data of the first and second relational expressions, and the intervals of sound sources stored in the memory 1602, which are calculation results obtained by the controller 1601.

The communication interface 1605 is, for example, a short-range wireless communication (e.g., Bluetooth (registered trademark)) module, a wired local area network (LAN) module, a wireless LAN module, etc., and is an interface to perform a wired or wireless communication via a network. The communication interface 1605 is an interface for connecting the acoustic control apparatus to external apparatuses (e.g., an automobile, a train, electrical equipment in a house; or a communication instrument provided on a computer, a server, or a network). The communication interface 1605 is controlled by the controller 1601 and is for receiving data, such as the positions of sound sources, frequencies and phase characteristics of sound sources, the range of a quiet area, the position of the user 251, the range of a space to be acoustically controlled, and the like, from other devices and/or other terminal devices, such as a server, via a network, etc. Furthermore, the communication interface 1605 is a device for setting data of the first and second relational expression calculated by the acoustic control apparatus and an acoustic filter coefficient provided separately, or for transmitting the data to terminal devices (e.g., a smartphone and/or a computer), etc. via a network, etc. The user may set an acoustic filter coefficient via a terminal device. Also, a program to be executed at the acoustic control apparatus is preliminarily stored in a particular server (not shown), etc., and the communication interface 1605 may be an interface for downloading the program from the particular server, and the terminal device may be a device for uploading the program. If a terminal device receives the program, then the program is to be executed at the terminal device to generate first and second relational expression data, and the terminal device presents and/or set the data.

In addition, the communication via a network may be wireless or wired. The network, etc. may be an Internet work including the Internet, or a network of other type, like an in-house LAN, or a one-to-one communication using a universal serial bus (USB) cable. The communication interface 1605 may include a micro USB connector.

The input device 1606 is a device accepting input, and is, for example a touch panel, a physical button, a mouse, a keyboard, and the like. The output device 1607 is a device for performing output, outputs information by means of a display, voice, etc., and is, for example, a display, and a loudspeaker, etc. Data, such as the positions of sound sources, the frequencies and phase characteristics of the sound sources, the range of a quiet region, the position of the user 251, the range of a space to be acoustically controlled, etc. may be input by the input device 1606.

The external interface 1608 is an interface for serving as a medium between the main body of the acoustic control apparatus and external devices, and is, for example, a USB port, etc., and is an interface for connecting the main body of the acoustic control apparatus to external devices (e.g., a printer, memory, and communication instrument).

Figure 17:
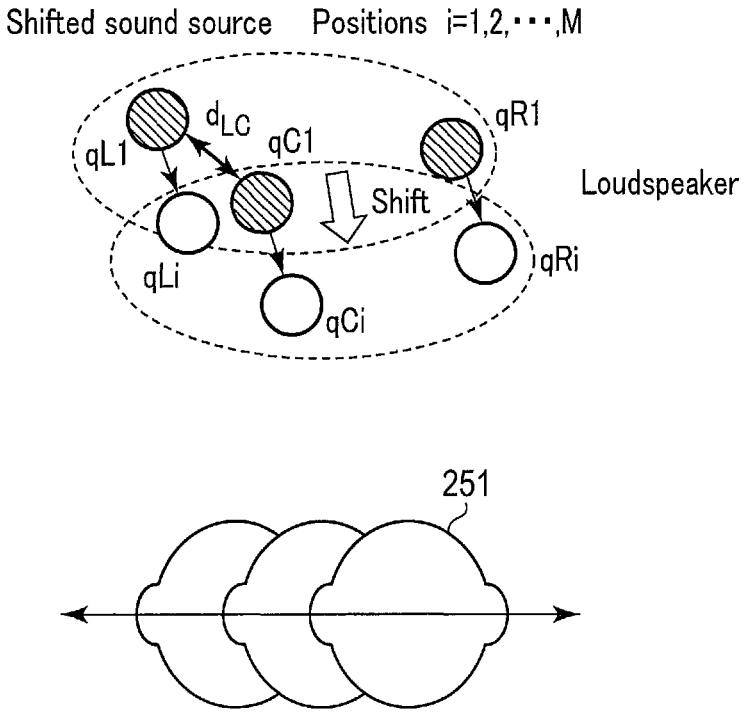
FIG. 17 is a view for illustrating a case where the positions of sound sources are shifted, and the position of the user is also shifted.

Next, the case where sound sources are shifted will be described with reference to FIGS. 17 to 20. It is assumed that the distance between the sound sources shown in the figure is fixed. FIG. 17 is a view for illustrating a case where the sound sources and the user 251 are shifted.

For the sound sources shown in FIG. 17, a sound source position i (i=1, 2, . . . , M) is set for each sound source group. When a sound source is shifted, the numerical value i of the sound source position changes. In this example, there are sound source positions of M patterns. In FIG. 17, three sound sources are arranged at approximately a fixed distance from the user, and complex volume velocities qLi, qCi, and qRi are set for each sound source group. The three sound sources are set on a steering wheel of an automobile, for example. In addition, since a driver is usually seated at a driver seat and does not move to other seats during driving, it is presumed that the percent that the head of the driver moves in the horizontal direction with respect to the steering wheel is the largest. For this reason, in the example of FIG. 17, it is assumed that the user 251 (corresponding to the driver) is shifted in the horizontal direction (right and left) toward each sound source.

Figure 18:
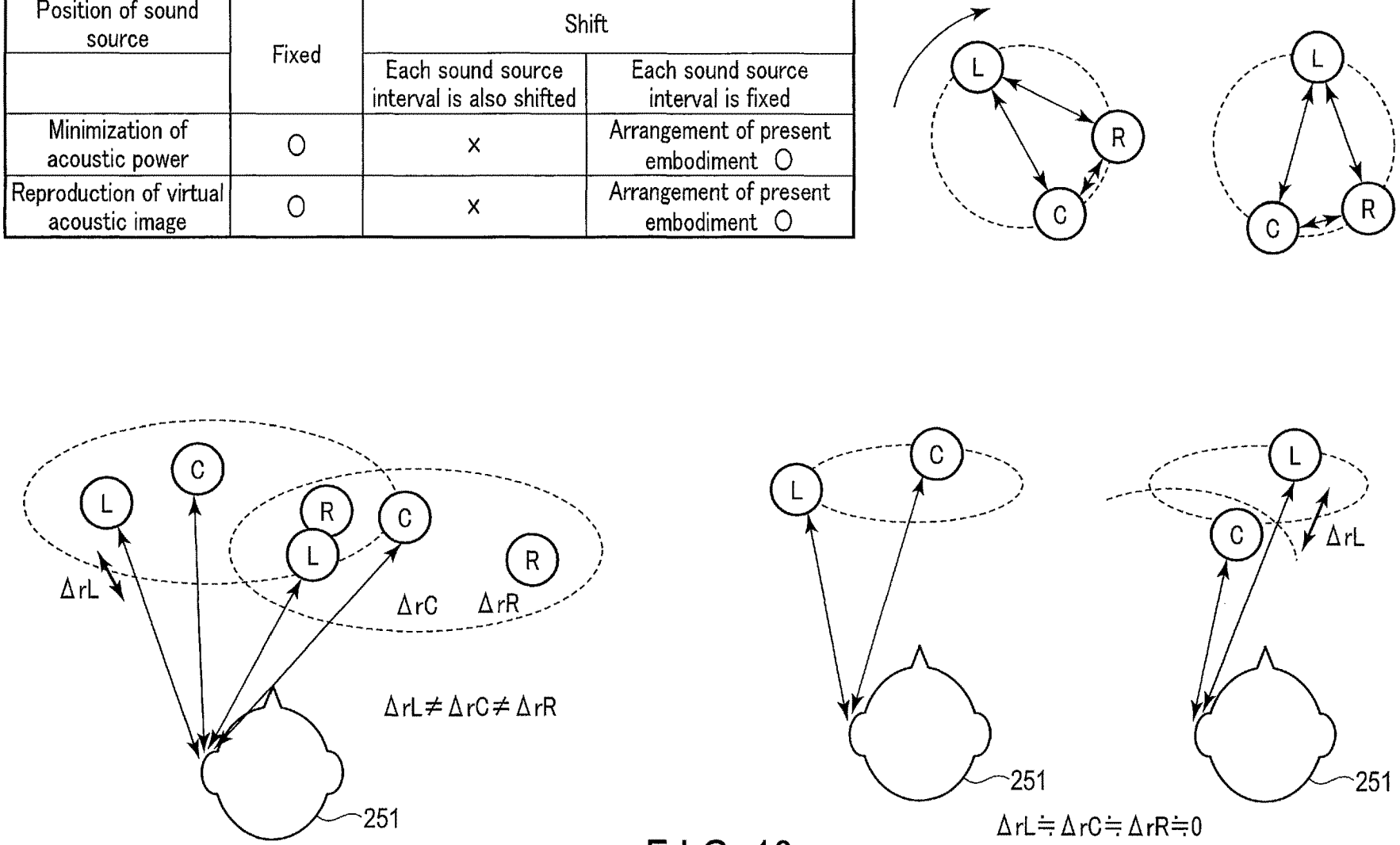
FIG. 18 is a view for illustrating the acoustic power minimization and the virtual acoustic image reproduction in the acoustic control apparatus according to an embodiment, and changes of FIG. 17.
Figure 19:
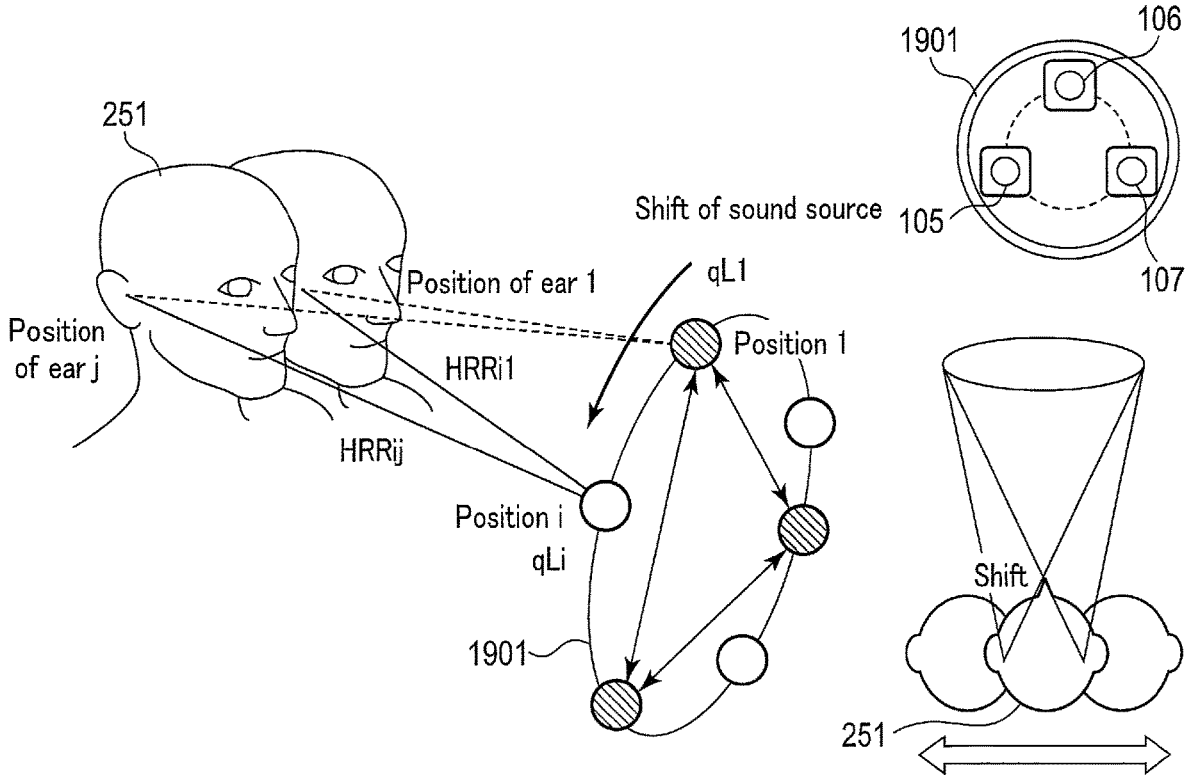
FIG. 19 is a view for illustrating the case where loudspeakers are mounted on a steering wheel.
Figure 20:
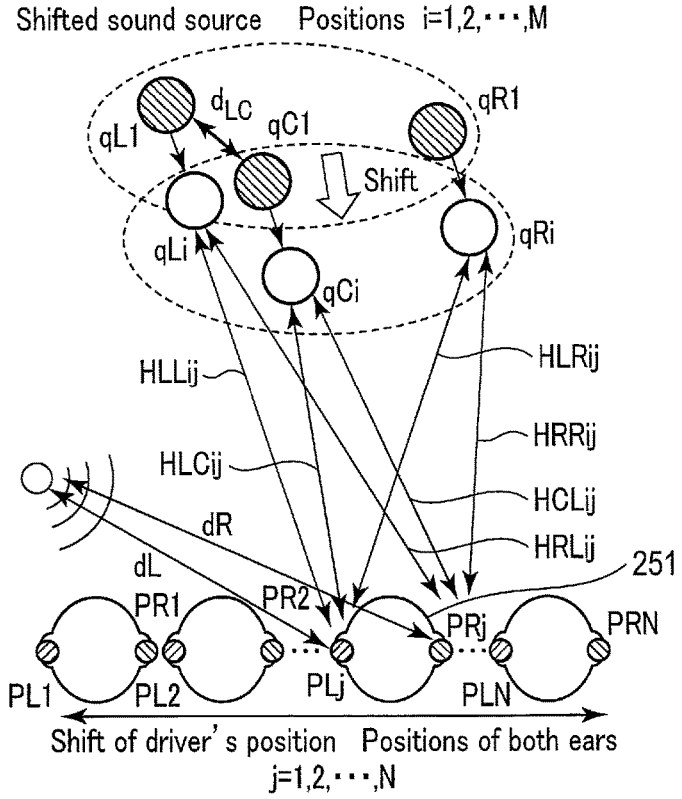
FIG. 20 is a view for illustrating calculations in the case of the virtual acoustic reproduction in the changes shown in FIG. 17.

Next, if the sound sources are arranged as shown in FIG. 17, whether or not the acoustic power minimization and the virtual acoustic image reproduction can be applied will be discussed with reference to FIGS. 18, 19, and 20. FIG. 18 is a view for illustrating the case where three sound sources are arranged on a steering wheel and how the rotating steering wheel has an influence on the acoustic power, and a virtual acoustic image. FIG. 19 is a view for illustrating the case where loudspeakers as sound sources are mounted on a steering wheel. FIG. 20 is a schematic view of the case where a plurality of sound sources are shifted, and the position of the driver is shifted in the horizontal direction with respect to a surface where the sound sources are arranged.

As is clear from the positions of the sound sources which are shifted when the steering wheel shown in FIG. 18 is rotated, the sound sources are fixed at the steering wheel, and thus the distance between the sound sources (each sound source interval) is constant. Therefore, the acoustic power minimization depends on the distances between sound sources and the wavenumbers of sounds from the sound sources. Therefore, even if the sound sources are mounted on the steering wheel and the positions of these sound sources are shifted by the rotation of the steering wheel, this does not have an influence on the calculation result of the acoustic power minimization.

In addition, due to such a transfer of sound sources, shifts in distance (referred to as "ΔrL", "ΔrC", and "ΔrR" for each sound source) from the ears of the user 251 to the respective sound sources do exist, and in general, the respective shifted distances become different values. However, in usual driving of an automobile, rotating a steering wheel largely (e.g., rotating the steering wheel by 90°) rarely occurs, and a driver rotates a steering wheel by 10° or so at most. In the case where sound sources are rotated by 10°, the shift in distance from the ears of the driver to the sound sources becomes 15/1000 or so of the distance from the ears to the sound source, if roughly estimated. Therefore, the shifts in distance, ΔrL, ΔrC, and ΔrR included in the calculation give only a contribution with a degree of 1/100 or so, assuming that an error of line shape is included in the calculation result (i.e., primary expression, ΔrL, etc.), and just only an error of such a degree takes place even when the calculation is performed assuming that there is no shifts. In addition, since the virtual acoustic image reproduction is performed by spatial averaging, such a small shift of the steering wheel does not influence the calculation. For example, when the distance from the ears to the steering wheel is set to 50 cm, the shift in distance from the ears to the sound sources when the sound source is rotated by 10° is just 75 mm or so.

For this reason, there is almost no shifts in space transfer function from sound sources to the ears as shown in FIG. 20, either. Therefore, it is understood that the calculation result is robust with respect to the rotation of a steering wheel through a spatial mean control even if there are a plurality of sound sources.

As a result, sound sources may be arranged on a steering wheel 1901 as shown in FIG. 19. Sound sources, such as the loudspeakers 105, 106, and 107, may be arranged on the internal side of the steering wheel. In addition, the sound sources may be arranged inside the steering wheel, and the arrangement of the sound sources may be fixed such that the sound sources are not shifted.

The same discussions as those described above may be also applied to the case where the user 251 shifts in the horizontal direction (in a parallel direction) with respect to the steering wheel. Therefore, it is understood that calculation results of the acoustic power minimization and the virtual acoustic image reproduction are robust also even when the user shifts in the horizontal direction with respect to the steering wheel.

On the other hand, the calculation of the acoustic energy minimization relates to a space transfer function between a quiet region and sound sources and complex volume velocities of the sound sources as described using FIG. 15. Through the above discussions, it turned out that the space transfer function changes very little, and the complex volume velocities do not vary by shifts of the sound sources. Therefore, it is understood that even if sound sources are shifted as shown in FIGS. 17 to 20, the calculation of the acoustic energy minimization is robust in relation to the shifts of the sound sources, without being influenced by the shifts of the sound sources.

Also, through the above discussions, it is also understood that an arrangement of sound sources fixed on a panel, etc. other than a steering wheel and an arrangement of sound sources arranged on a steering wheel and the positions and the directions of the sound sources are shifted may be employed in a mixed manner.

As described above, according to the acoustic control apparatus of the present embodiment, it is possible to increase the sound pressure level in a particular region within a space and to reduce the sound pressure level in other particular regions by using the acoustic power minimization, virtual acoustic image reproduction, and acoustic energy minimization. Also, according to the acoustic control apparatus of the present embodiment, even when in an automobile, etc., equipped with four seats, sound sources are provided on its steering wheel, etc., and the sound sources are shifted and the head of the driver is also shifted, it is possible to provide an acoustic environment which is quire at its VIP seat, while allowing the driver to hear voices.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

<1>

According to the acoustic control apparatus of the present embodiment described above, it is possible to control an acoustic environment such that music can be heard in only a particular region in the same space. The acoustic control apparatus allows control of an acoustic environment such that only a person residing in a particular region can listen to music without earphones and headphone, even when a plurality of persons reside in the same space.

<2>

The apparatus of the present invention can be achieved even by a computer and a program, and the program can be recorded in a recording medium (or a storage medium) and provided through a network.

In addition, the respective devices described above and device portions thereof can be implemented with either a hardware configuration or a combined configuration of a hardware resource and software. As the software in the combined configuration, a program for causing a computer to achieve operations (or functions) of the respective devices by being installed preliminarily to the computer from a network or a computer-readable recording medium (or storage medium) and being implemented by a processor of the computer.

<3>

Furthermore, the expression, "and/or", means discretional one or more matters out of the matters linked to and enumerated with "and/or". A specific example of the "and/or" has a meaning of any one of elements out of an aggregate composed of three elements {(x), (y), and (x, y)}. As another specific example, the expression "x, y, and/or z" has a meaning of any one of elements out of an aggregate composed of seven elements {(x), (y), (z), (x, y), (x, z), (y, z), and (x, y, z)}.

What is claimed is:

1. An acoustic control apparatus comprising:

an acquisition unit that obtains a sound signal including sound information, the sound signal being based on sounds emitted from sound sources;

a first calculator that calculates a first relationship established between acoustic filter coefficients, based on the sounds which are driven by a drive signal obtained by applying the sound signal to the acoustic filter coefficients set for each sound source;

a second calculator that calculates a second relationship established between the acoustic filter coefficients by matching a first sound pressure ratio with a second sound pressure ratio, in a complex sound pressure ratio between ears of a user who desires the sound information, the first sound pressure being based on a synthetic sound of the sounds emitted from the sound sources, and the second sound pressure being based on a virtual sound source, assuming that the virtual sound source of a virtual acoustic image is present in an incoming direction of the synthetic sound; and a first setting unit that sets an acoustic filter coefficient corresponding to each of the sound sources, based on the first relationship and the second relationship.

2. The apparatus according to claim 1, wherein the first calculator is configured to calculate the first relationship established between the acoustic filter coefficients so as to minimize the acoustic power of the sound sources, based on wavelengths of the sounds emitted from the sound sources and each distance between the sound sources.

3. The apparatus according to claim 1, further comprising:

a second setting unit that sets a correction filter coefficient for correcting at least one of the acoustic filter coefficients, based on a reducing limitation index of acoustic power determined in accordance with the each distance between the sound sources and wavelengths of the sounds emitted from the sound sources.

4. The apparatus according to claim 3, further comprising:

a determination unit that determines whether or not the each distance between the sound sources allows the acoustic power to be reduced based on the reducing limitation index.

5. The apparatus according to claim 1, wherein the first calculator calculates the first relationship established between the acoustic filter coefficients so as to minimize, in a desired region, acoustic energy from the sounds emitted from the sound sources.

6. The apparatus according to claim 1, wherein the first calculator and the second calculator calculate the first relationship and the second relationship, respectively, based on sounds emitted from the sound sources arranged at different distances from the user in a same direction from the user.

7. The apparatus according to claim 1, wherein the first calculator and the second calculator calculate the first relationship and the second relationship, respectively, based on sounds when vibrating surfaces of sounds emitted from the sound sources based on the same sound information arrive at the user at different points of time.

8. The apparatus according to claim 6, wherein the second calculator sets a virtual sound source such that a direction of the virtual sound source coincides with a direction in which the sound sources are present as viewed from the user.

9. The apparatus according to claim 1, wherein the first calculator and second calculator calculate the first relationship and second relationship, respectively, based on sounds generated from the sound sources arranged in a circular shape on a plane that is regarded as being perpendicular within a range as viewed from the user.

10. A non-transitory computer readable medium storing a computer program which is executed by a computer to provide the steps of:

obtaining a sound signal including sound information, the sound signal being based on sounds emitted from sound sources;

calculating a first relationship established between acoustic filter coefficients, based on the sounds which are driven by a drive signal obtained by applying the sound signal to the acoustic filter coefficients set for each sound source;

calculating a second relationship established between the acoustic filter coefficients by matching a first sound pressure ratio with a second sound pressure ratio, in a complex sound pressure ratio between ears of a user who desires the sound information, the first sound pressure being based on a synthetic sound of the sounds emitted from the sound sources, and the second sound pressure being based on a virtual sound source, assuming that the virtual sound source of a virtual acoustic image is present in an incoming direction of the synthetic sound; and setting an acoustic filter coefficient corresponding to each of the sound sources, based on the first relationship and the second relationship.

11. A device comprising the acoustic control apparatus according to claim 1.

12. An acoustic control method comprising:

obtaining a sound signal including sound information, the sound signal being based on sounds emitted from sound sources;

calculating a first relationship established between acoustic filter coefficients, based on the sounds which are driven by a drive signal obtained by applying the sound signal to the acoustic filter coefficients set for each sound source;

calculating a second relationship established between the acoustic filter coefficients by matching a first sound pressure ratio with a second sound pressure ratio, in a complex sound pressure ratio between ears of a user who desires the sound information, the first sound pressure being based on a synthetic sound of the sounds emitted from the sound sources, and the second sound pressure being based on a virtual sound source, assuming that the virtual sound source of a virtual acoustic image is present in an incoming direction of the synthetic sound; and setting an acoustic filter coefficient corresponding to each of the sound sources, based on the first relationship and the second relationship.

* * * * *